US005419423A

United States Patent [19]

Ishida et al.

[11] Patent Number: 5,419,423

[45] Date of Patent: May 30, 1995

[54] PAPER MONEY PROCESSOR

[75] Inventors: Takeshi Ishida; Shigeru Yasuda, both of Sakado; Seiji Yoshitake, Tsurugashima, all of Japan

[73] Assignee: Kabushiki Kaisha Nippon Conlux, Tokyo, Japan

[21] Appl. No.: 161,943

[22] Filed: Dec. 3, 1993

[30] Foreign Application Priority Data

Dec. 3, 1992 [JP] Japan ..... 4-324478

[51] Int. Cl.[6] ..... G07F 7/04

[52] U.S. Cl. ..... 194/206; 194/207; 271/180

[58] Field of Search ..... 194/206, 207; 271/177, 271/180, 181

[56] References Cited

U.S. PATENT DOCUMENTS

| | | |
|---|---|---|
| 4,011,931 | 3/1977 | Wyckoff . |
| 4,540,081 | 9/1985 | Mori et al. . |
| 4,556,139 | 12/1985 | Akagawa et al. . |
| 4,678,072 | 7/1987 | Kobayashi et al. . |
| 4,765,607 | 8/1988 | Zouzoulas . |
| 4,784,274 | 11/1988 | Mori et al. . |
| 4,809,966 | 3/1989 | Kobayashi et al. . |
| 5,005,688 | 4/1991 | Yukomoto et al. . |
| 5,195,739 | 3/1993 | Watabe . |

FOREIGN PATENT DOCUMENTS

| | | |
|---|---|---|
| 55-37466 | 9/1980 | Japan . |
| 63-252870 | 10/1988 | Japan . |
| 2183390 | 7/1990 | Japan . |
| 346955 | 2/1991 | Japan . |
| 431642 | 7/1992 | Japan . |
| 4296009 | 9/1993 | Japan . |

*Primary Examiner*—Michael S. Huppert
*Assistant Examiner*—Scott L. Lowe
*Attorney, Agent, or Firm*—Welsh & Katz, Ltd.

[57] ABSTRACT

A paper money processor using a single motor in which, when the motor is forwardly driven, a power transmission section transmits a rotational force of the motor only to a paper money transporter section to convey an inserted paper money into the interior of a processor body and when the motor is reversely driven, the power transmission section transmits the rotational force of the motor to both of the paper money transporter section and a pushing section to drive the both so as to return the paper money back to a paper money insert slot, and when a repayment demand occurs, a control section permits the reverse rotation of the motor only if the paper money is located at a returnable position.

11 Claims, 34 Drawing Sheets

| BLOCK | P1RL | SHUT | P2 | T3S | INH | JUDGEMENT ON DEMAND |
|---|---|---|---|---|---|---|
| SUB 1 | 1 | 0 | 0 | N | 1 | ON |
| SUB 2 | 1 | — | 0 | N | 1 | ON |
| SUB 3 | 1 | 1 | 0 | N | 1 | ON |
| SUB 4 | — | 1 | 0 | N | 1 | ON |
| SUB 5 | 0 | 1 | — | N | 1 | ON |
| SUB 6 | — | — | 1 | N | — | OFF |
| SUB 7 | — | — | 0 | N | — | OFF |

FIG.37

PAPER MONEY PROCESSOR

BACKGROUND OF THE INVENTION

1. Field of the Invention

The present invention relates to a bill or paper money processor in which inserted bills or paper moneys are discriminated between true and false bills and the true bills are pushed in a paper money accommodation box as accumulated therein.

2. Description of the Related Art

In general, such a machine for handling paper moneys as a vending machine includes a body into which installed is a paper money processor for discriminating whether an inserted paper money is genuine or false and accepting and accumulating only the paper money regarded as genuine.

Such a paper money processor is roughly comprised of a paper money transporter section for feeding a paper money inserted through a paper money insert slot into the interior of the machine, a data reading section for reading data for discrimination of whether the transported paper money is genuine or false, a paper money accommodation section having pushing means for pushing the carried paper money into a paper money accommodation box for its accumulative accommodation, and a driver section for transmitting driving forces to the pushing means and the paper money transporter section.

The driver section of the prior art paper money processor for transmitting driving forces to the pushing means and the paper money transporter section includes a first driving motor for driving only the aforementioned paper money transporter section and a second driving motor for driving only the pushing means for pushing the fed paper money into the paper money accommodation box.

In the above paper money processor, however, the driver section for transmitting driving forces to the pushing means and paper money transporter section requires the separate first and second driving motors for driving the paper money transporter section and for driving the pushing means, which results in that not only the structure of the paper money processor becomes complicated and high in the manufacturing cost but also a space for disposing the two motors is necessary, thus hindering the realization of a compact paper money processor.

There has been suggested a paper money processor which uses a single motor to transport an inserted paper money and to drive pushing means, thus making small in size. This paper money processor includes power transmission means for transmitting forward and reverse rotational torques or forces of the single motor to a paper money transporter section and when it is desired to reversely rotate the motor, for transmitting the rotational force to the pushing means.

With such an arrangement as mentioned above, when it is desired to rotate the motor reversely, the rotational force of the motor can be transmitted to the pushing means. However, the reverse rotation of the motor causes the paper money transporter section to also be driven in such a direction as to return or repay an inserted paper money, which results in that, when the inserted paper money is transported up to an unreturnable position, e.g., to a position downstream a paper money pull-out prevention lever and when the paper money transporter section is also driven in such a direction as to return the paper money, this causes paper money jamming to take place at the paper money pull-out prevention lever position, thus hindering proper operation of the paper money processor.

SUMMARY OF THE INVENTION

It is an object of the present invention to provide a paper money processor which employs a single motor for the purpose of transporting an inserted paper money and driving pushing means while preventing any paper money jamming.

In accordance with an aspect of the present invention, the above object is attained by providing a paper money processor which comprises a paper money transporter section for transporting a paper money inserted through a paper money insert slot along a paper money transportation path into an interior of a processor body; a data reader section disposed in the paper money transportation path for reading data for determination of whether or not the inserted paper money is genuine; a paper money accommodation section having means for pushing the transported paper money determined to be genuine on the basis of the data read out by the data reader section into a paper money accommodation box for accumulative accommodation; a driver section for transmitting driving forces to the paper money transporter section and the pushing means; the driver section including a single motor and power transmission means for transmitting a rotational force of the motor only to the paper money transporter section to cause only the paper money transporter section to convey the paper money into the interior of the processor body when the motor is forwardly driven and for transmitting a rotational force of the motor both of the paper money transporter section and the pushing means to cause the paper money transporter section to convey and return the paper money toward the paper money insert slot when the motor is reversely driven and; control means, when a repayment demand occurs, for causing the single motor to be reversely driven so long as the paper money inserted through the paper money insert slot is at a returnable position.

That is, in the present invention, the position of the paper money inserted through the paper money insert slot is monitored so that, when the repayment demand occurs, the motor can be reversely driven so long as the paper money is at the money returnable position.

With such an arrangement as mentioned above, there is provided a paper money processor which structure can be simplified with low manufacturing costs and also can prevent paper money jamming.

BRIEF DESCRIPTION OF THE DRAWINGS

FIG. 37 is a table showing the operations of the subroutines SUB1 to SUB7 shown in FIGS. 30 to 36;

DESCRIPTION OF THE PREFERRED EMBODIMENTS

A paper money processor in accordance with an embodiment of the present invention will be detailed with reference to the accompanying drawings.

Figure 1:
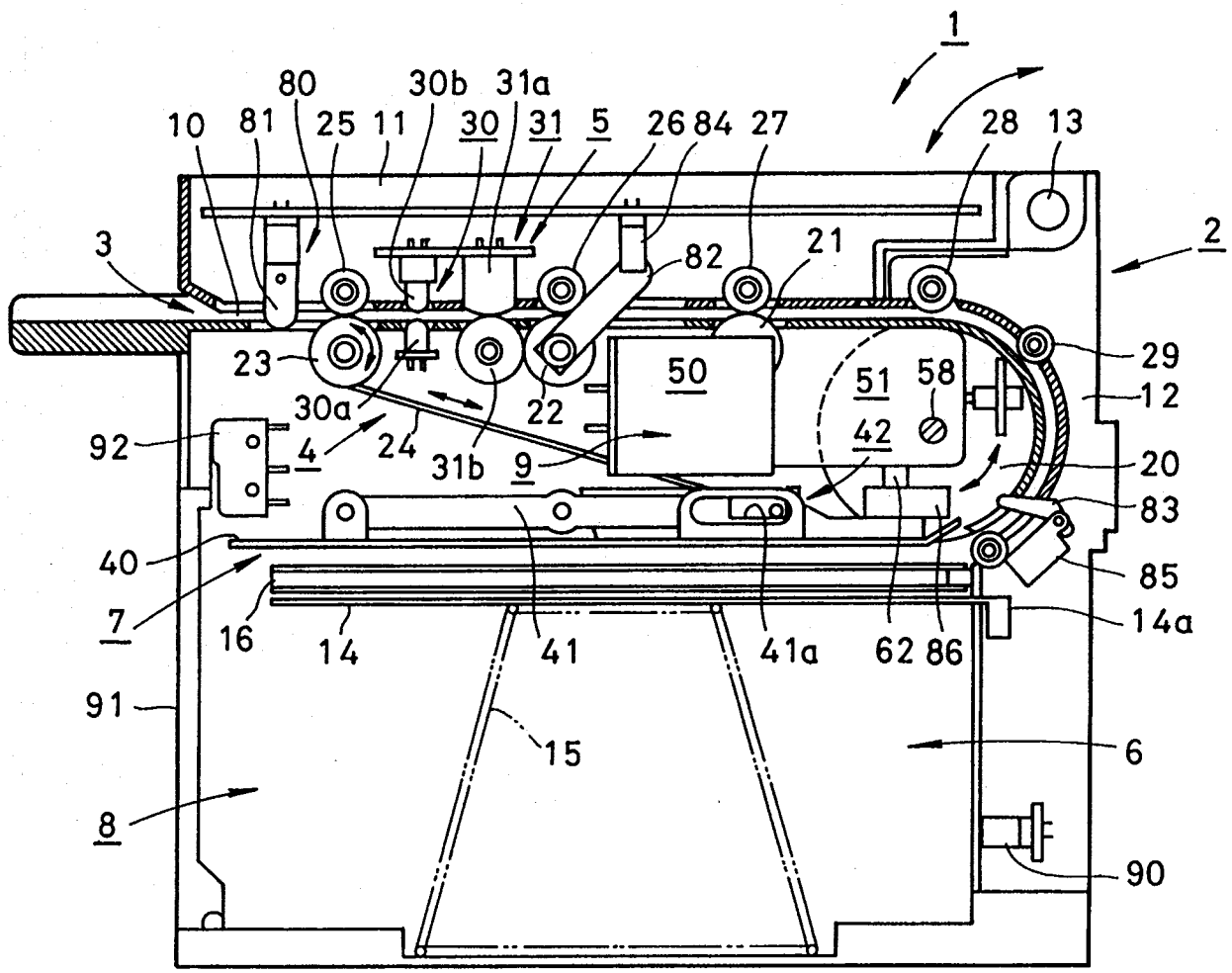
FIG. 1 is a side view of a paper money processor in accordance with an embodiment of the present invention.

Turning first to FIG. 1, there is shown a side view of a paper money processor 1 in accordance with the present invention. The paper money processor 1 includes a processor body 2. Disposed within the processor body 2 are a paper money transporter section 4 of a belt type for transporting a paper money inserted through a paper money insert slot 3 into an interior of the processor body 2, a data reader section 5 disposed intermediate of the paper money transporter section 4 for reading data from the inserted paper money to discriminate whether the transported paper money is false or genuine, a paper money accommodation section 8 having pushing means 7 for pushing the paper money fed through the paper money transporter section 4 into a paper money accommodation box 6 for its accumulative accommodation, and a driver section 9 for transmitting driving forces to the paper money transporter section 4 and the pushing means 7 of the paper money accommodation section 8 respectively.

In more detail, the processor body 2 is comprised of upper and lower casings 11 and 12 which are provided as opposed to each other to define a paper money transportation path 10 therebetween. The upper casing 11 is pivotally supported to the lower casing 12 to be opened and closed on a pivot 13. Thus, when it is desired to correct paper jamming or maintenance and/or inspection is required, the upper casing 11 is rotated on the pivot 13 in its clockwise direction and the user can easily access to the paper money transportation path 10 and can correct the paper jamming or conduct the maintenance and/or inspection.

The data reader section 5 includes an optical sensor 30 for detecting light passed through the paper money being fed along the paper money transportation path 10 and a magnetic sensor 31 for detecting the magnetism of the paper money. In the present embodiment, it is determined on the basis of output signals of light and magnetic sensors 30 and 31 whether the inserted paper money is false or genuine. More specifically, the optical sensor 30 comprises light emitting and receiving elements 30*a* and 30*b* disposed in the upper and lower sides of the paper money transportation path 10 as spaced by a predetermined distance therebetween; whereas the magnetic sensor 31 comprises a magnetic head 31*a* and a pressure roller 31*b* mounted as pressingly contacted with the magnetic head 31*a*.

Provided below the lower casing 12 is the paper money accommodation box 6 into which a stacker plate 14 for accumulatively or stackingly carrying paper moneys thereon and a coil spring 15 for resiliently pushing the stacker plate 14 from its bottom side at all times. Disposed within the paper money accommodation box 6 is a guide member 16 having a generally U-shaped configuration in section, so that, when the paper money guided onto the upper surface of the guide member 16 is pushed down toward the lower surface of the guide member 16 by the pushing means 7, the paper money is held as pushed between the lower surface of the guide member 16 and the upper surface of the stacker plate 14 and thus placed thereon as accommodated in the paper money accommodation box 6.

Meanwhile, the paper money transporter section 4 includes driving pulleys 20, 21, 22 and 23 disposed as partly exposed to an interior of the paper money transportation path 10, a cocked belt 24 of a resilient material wound around the driving pulleys 20, 21, 22 and 23, and follower rollers 25, 26, 27, 28 and 29 disposed as contacted with the front surface of the cocked belt 24.

With the paper money transporter section 4 having such a structure as mentioned above, when the driving pulley 20 having a larger diameter is drivingly turned in its clockwise direction, this causes the inserted paper money to be forcibly pulled and transported into the interior of the processor body 2 with the paper money being kept between the cocked belt 24 and the follower rollers 25, 26, 27, 28 and 29.

The pushing means 7 of the paper money accommodation section 8 includes a lift table 40 to be vertically moved up and down to push the paper money guided on the upper surface of the guide member 16 toward the lower surface of the guide member 16, a link device 41 of a pantograph structure to be vertically moved up and down with the parallelism of the lift table 40 being kept, and a slide device 42 engaged with a part 41*a* of the link device 41 for driving the link device 41.

Figure 2:
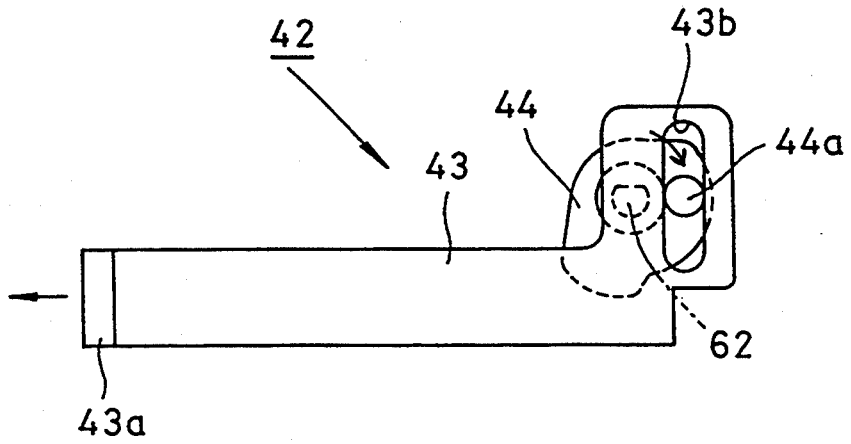
FIG. 2 is a partially magnified view of a slide device used in the paper money processor of FIG. 1 for explaining the operation of the slide device.
Figure 3:
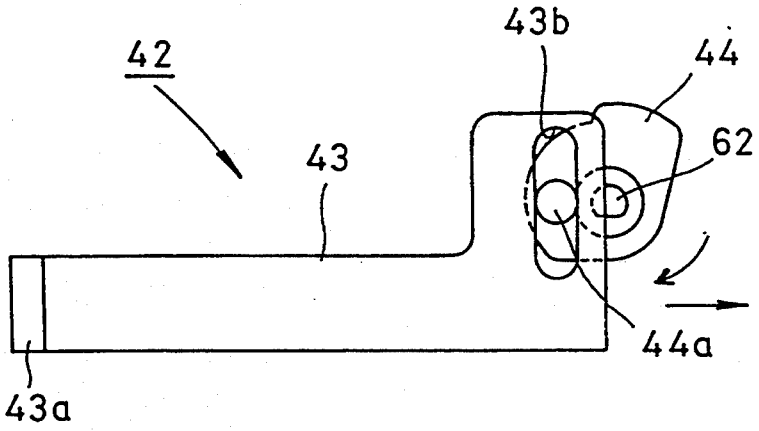
FIG. 3 is a partially magnified view of the slide device used in the paper money processor of FIG. 1 for explaining the operation of the slide device.

The slide device 42 in turn, as shown by its magnified bottom views in. FIGS. 2 and 3, has a slider 43 provided at its tip or leading end with a tilted surface 43*a* and in its rear end with a guide slot 43*b* and also has a cam 44 having a pin 44*a* engaged in the guide slot 43*b* of the slider 43. When the cam 44 is rotated about a stack output shaft 62 (which will be explained later) by an angle of 90 degrees in one angular direction from such an initial position of the slider 43 as shown in FIG. 2, the slider 43 is moved forwardly as shown in FIG. 3. When the cam 44 is further rotated by an additional angle of 90 degrees in one direction, the slider 43 is returned to its initial position shown in FIG. 2. That is, in the slide device 42, one turn of the cam 44 causes the slider 43 to perform a reciprocating movement from the initial position of FIG. 2 through the forwardly moved position of FIG. 3 again to the initial position of FIG. 2.

Figure 4:
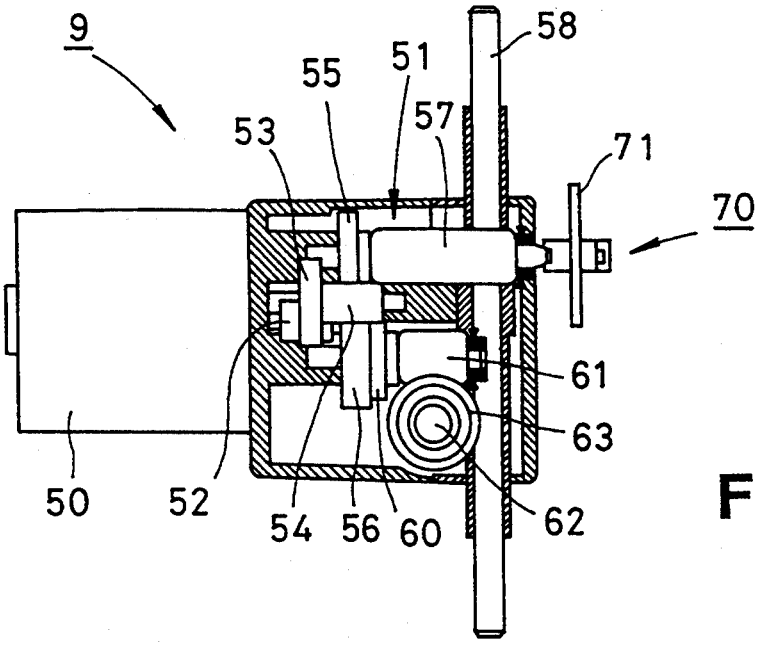
FIG. 4 is a partially magnified cross-sectional view of a driver section used in the paper money processor of FIG. 1 as viewed from its top.
Figure 5:
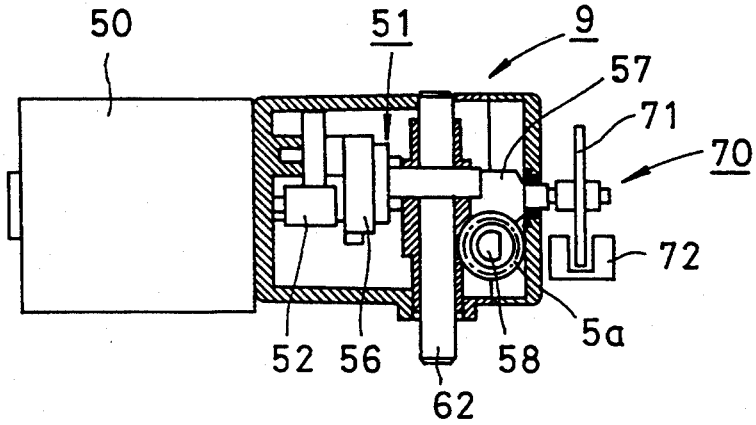
FIG. 5 is a partially magnified cross-sectional view of the driver section used in the paper money processor of FIG. 1 as viewed from its side.
Figure 6:
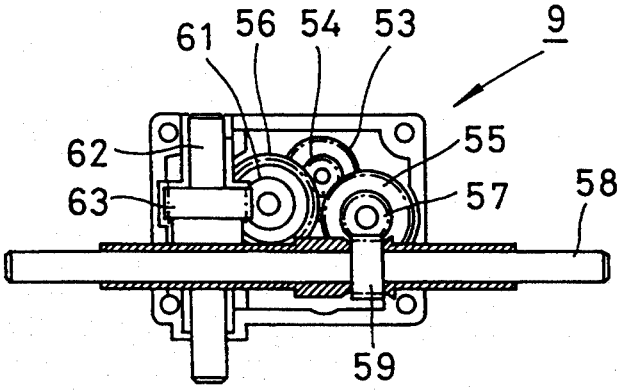
FIG. 6 is a partially magnified cross-sectional view of the driver section used in the paper money processor of FIG. 1 as viewed from its right side.

Meanwhile, the driver section 9 for transmitting driving forces to the paper money transporter section 4 and pushing means 7 respectively has such a structure as shown in FIGS. 4 to 6.

In FIGS. 4 to 6, the driver section 9 includes a single driving motor 50 and power transmission means 51 disposed within a casing for transmitting a rotating torque or force of the driving motor 50 therethrough. The power transmission means 51 has a pinion 52 fixedly mounted to an output shaft of the driving motor 50, a gear 53 meshed with the pinion 52 at all times, a pinion 54 fixed to the gear 53, and first and second follower gears 55 and 56 meshed with the pinion 54 at all times. The first follower gear 55 is fixedly mounted to a worm gear 57 which in turn is engaged to a worm wheel 59 at all times as shown in FIG. 6. The worm wheel 59 is fixedly mounted to a transportation output shaft 58 for drivingly rotating the larger-diametered driving pulley 20 in the aforementioned paper money transporter section 4.

Therefore, the transportation output shaft 58 for drivingly rotating the driving pulley 20 of the paper money transporter section 4 is rotated at all times following the rotation of the driving motor 50 either forward and reverse directions. That is, when the driving motor 50 turns in its forward direction, the transportation output shaft 58 is also rotated in its forward direction; while, when the motor 50 turns in its reverse direction, the output shaft 58 is also rotated in its reverse direction.

Disposed inside the second follower gear 56 meshed with the pinion 54 of the aforementioned power transmission means 51 is a one-way clutch 60 as shown in FIG. 4, through which clutch 60 the second follower gear 56 is connected to a worm gear 61. The worm gear 61 in turn is engaged to a worm wheel 63 which is fixedly mounted onto a stack output shaft 62 for drivingly rotating the cam 44 of the slide device 42 shown in FIG. 2.

Thus, when the driving motor 50 turns in one direction, i.e., only in the reverse direction, the stack output shaft 62 for drivingly rotating the cam 44 of the slide device 42 receives power from the motor-and is rotated under the action of the one-way clutch 60; while, when the motor 50 turns in the other direction, i.e., in the forward direction, the stack output shaft 62 fails to receive the power and thus the rotation of the shaft 62 is stopped.

An encoder for detection of a rotation of the worm gear 57 for rotating the transportation output shaft 58, which is generally denoted by reference numeral 70, is comprised of a rotary disk 71 fixedly mounted to the worm gear 57 and a photosensor 72 for detecting a rotation of the rotary disk 71. The photosensor 72 generates a motor pulse MOPLS for detection of a transported position of the paper money to be explained later. In the present embodiment, the motor pulse MOPLS is counted and the transported position of the paper money is detected on the basis of a counted value CK of the motor pulse MOPLS.

Disposed on the way to the paper money transportation section 4 are, in addition to the aforementioned data reader section 5, a lever 81 driven by the inserted paper money, an inlet sensor 80 for detecting a pivotal movement of the lever 81, a pull-out prevention lever 82, a shutter switch 84 for detecting a pivotal movement of the pull-out prevention lever 82, a paper money passage lever 83, and a paper money passage detecting switch 85 for detecting a pivotal movement of the paper money passage lever 83. The inlet sensor 80 generates an inlet sensor signal PIRL having a level of "1" when the lever 81 is pivoted and a level of "0" when the lever 81 returns to its original position. The shutter switch 84 generates a shutter signal SHUT having a level of "1" when the pull-out prevention lever 82 is pivoted and a level of "0" when the pull-out prevention lever returns to its original position. Further, the paper money passage detecting switch 85 generates a paper money passage detection signal P2 having a level of "1" when the paper money passage lever 83 is pivoted and a level of "0" when the paper money passage lever returns to its original position. In the present embodiment, the inlet sensor 80 comprises an optical switch for optically detecting the operation of the lever 81 and the shutter switch 84 comprises an optical switch for optically detecting the operation of the lever 82, respectively. And the paper money passage detection switch 85 comprises a mechanical switch for mechanically detecting the operation of the paper money passage lever 83.

Mounted on the stack output shaft 62 is a carrier switch 86 which generates a carrier signal CARRY having a level of "1" when the driving motor 50 is driven in its reverse direction and a level of "0" when the motor is stopped.

A fully-stacked-money detection switch 90, which functions to detect the fact that the number of sheets of paper moneys accommodated within the paper money accommodation box 6 exceeds a predetermined number, comprises an optical switch for optically detecting a tongue piece 14*a* provided at the rear end of the stacker plate 14. The fully-stacked-money detection switch 90 generates a full detection signal FULLS having a level of "0" when the position of the stacker plate 14 does not reach the mounting position of the fully-stacked-money detection switch 90 and a level of "1" when the stacker plate 14 reaches the mounting position of the fully-stacked-money detection switch 90.

A safety switch 92, which is used to detect the open or closed state of a paper money collection cover 91, generates a safety signal SAFTY having a level of "0" when the paper money collection cover 91 is in its closed position and a level of "1" when the paper money collection cover 91 is in its open position.

In the present embodiment, the optical sensor 30 forming part of the data reader section 5 is comprised of three optical sensors PxL, PxC and PxR, while the magnetic sensor 31 is comprised of two magnetic sensors LHD and RHD. The optical sensors PxL and PxR detect the light passed through the paper money with use of infrared ray; whereas the optical sensor PxC detects the light passed through the paper money with use of red light.

Figure 7:
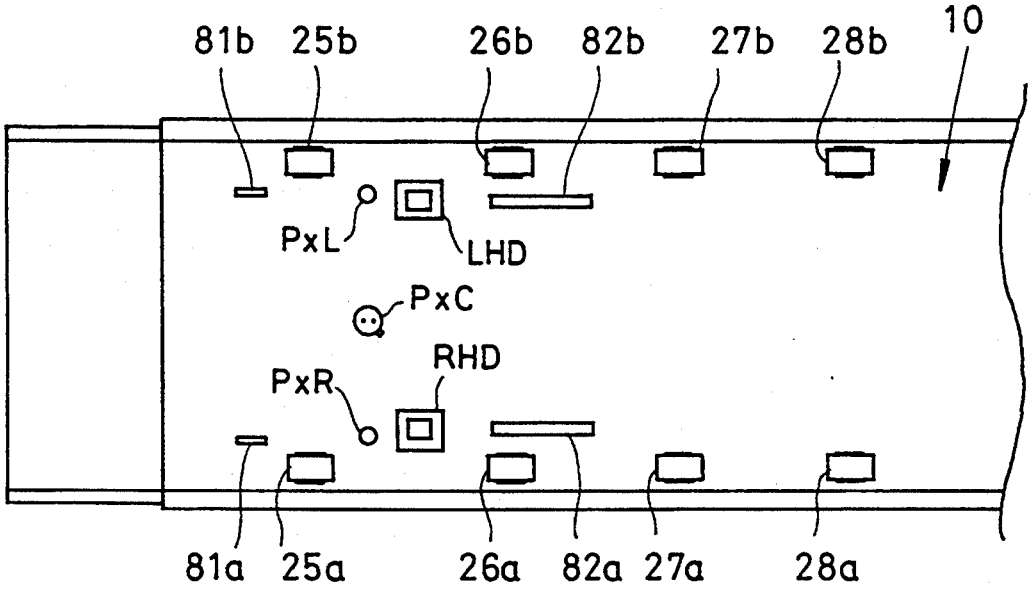
FIG. 7 is a diagram showing an array relationship between three optical sensors PxL, PxC and PxR and two magnetic sensors LHD and RHD.

FIG. 7 shows an array relationship between the three optical sensors PxL, PxC and PxR and the two magnetic sensors LHD and RHD. Of the three optical sensors PxL, PxC and PxR, the two optical sensors PxL and PxR are disposed at left and right sides of the paper money transportation path 10 therealong and the remaining optical sensor PxC is disposed in the center of the paper money transportation path 10. Further, the two magnetic sensors LHD and RHD are disposed at the right and left sides of the paper money transportation path 10 therealong.

The lever 81 driven by the inserted paper money shown in FIG. 1 is comprised of two levers 81*a* and 81*b* positioned at the left and right sides of the paper money transportation path 10 therealong, so that, only when the two levers 81*a* and 81*b* are simultaneously rotated, the inlet sensor 80 outputs the inlet sensor signal PIRL having a level of "1".

The pull-out prevention lever 82 shown in FIG. 1 is also comprised of two pull-out prevention levers 82*a* and 82*b* positioned at the left and right sides of the paper money transportation path 10 therealong.

Further, follower rollers 25*a*, 25*b*, 26*a*, 26*b*, 27*a*, 27*b*, 28*a* and 28*b* correspond to the follower rollers 25, 26, 27 and 28 in FIG. 1.

In the illustrated embodiment, it is judged on the basis of light data outputs of the three optical sensors PxL, PxC and PxR and magnetic data outputs of the two magnetic sensors LHD and RHD whether the inserted paper money is genuine or false, which will be detailed later.

Explanation will next be made as to the operation of the above paper money processor 1 and also the structure thereof in more detail.

Figure 8:
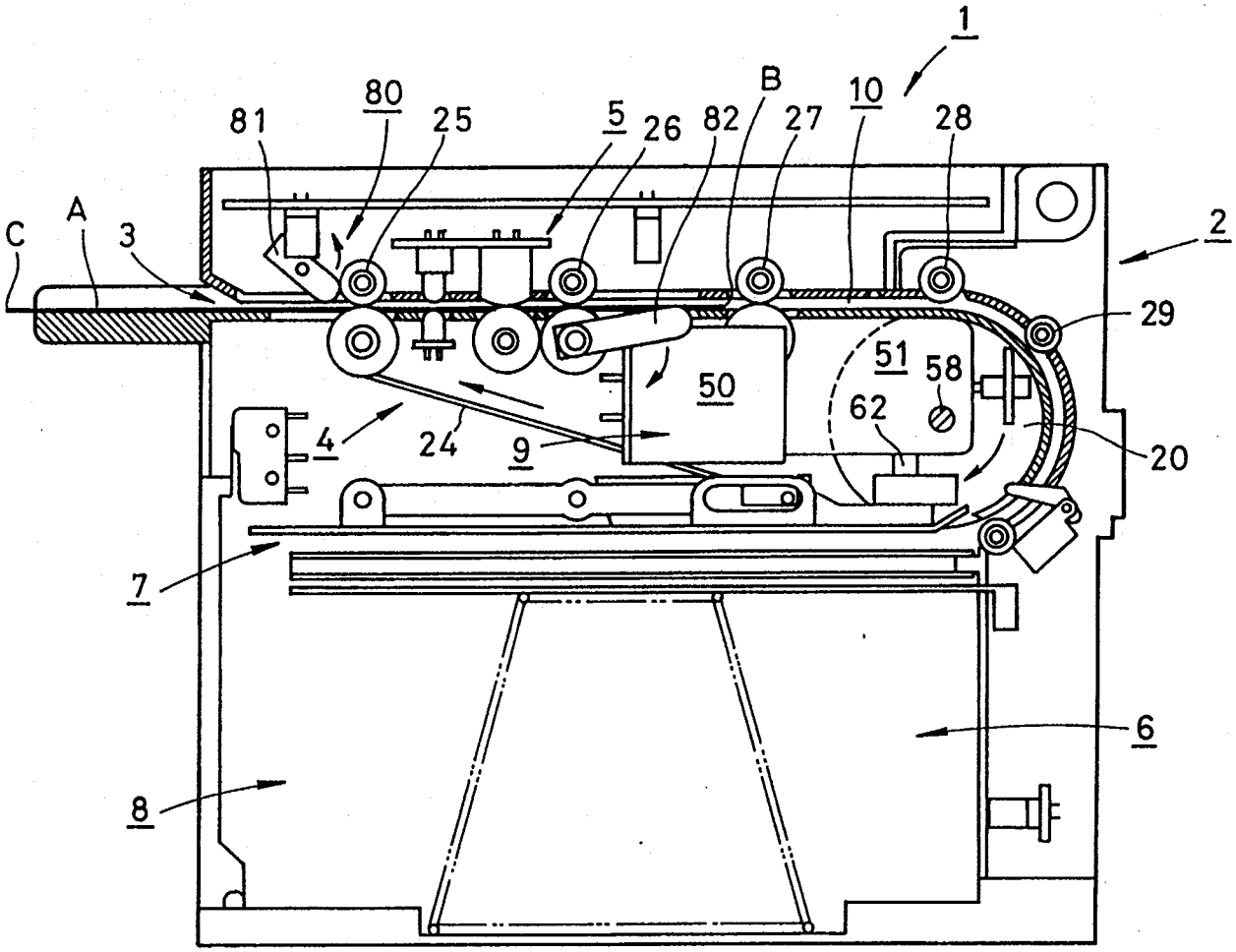
FIG. 8 is a side view similar to FIG. 1 for explaining the operation of the embodiment of FIG. 1 when an inlet sensor and a shutter switch in FIG. 1 are in operation.

First, when a user inserts a paper money A into the paper money insert slot 3 of the paper money processor 1, this causes the lever 81 of the inlet sensor 80 disposed adjacent to the paper money insert slot 3 to be pivoted on its pivot in a counterclockwise direction, whereby the pivotal rotation of the lever 81 is detected by the inlet sensor 80 and thus the insertion of the paper money A is detected. When the insertion of the paper money A is detected by the inlet sensor 80 as shown in FIG. 8, the driving motor 50 of the driver section 9 is rotated in the forward direction on the basis of the inlet sensor signal PIRL issued from the inlet sensor 80, so that the transportation output shaft 58 of the paper money transporter section 4 is rotated clockwise to drive the drive roller 20. This causes the paper money A to be held between the cocked belt 24.and the follower rollers 25, 26, 27, 28 and 29 and then transported along the paper money transportation path 10 within the processor body 2.

Meanwhile, while the driving motor 50 is rotated in the forward direction and the transportation output shaft 58 of the paper money transporter section 4 is rotated in the clockwise direction, the stack output shaft 62 for driving the pushing means 7 fails to be rotated under the action of the one-way clutch 60 (see FIG. 4) disposed in the power transmission means 51 of the driver section 9, which results in that the pushing means 7 of the paper money accommodation section 8 stops its operation and is put in such an initial position as shown in FIG. 8, i.e., in its wait mode.

Meanwhile, a leading end B of the transmitted paper money A causes a reverse-pull prevention lever 82 to be pivoted in its clockwise direction whereby the paper money A is further transmitted as shown in FIG. 8. The determination is made whether the paper money A is genuine or not on the basis of the optical data and the magnetic data read out by the data reader section 5 during a period until a trailing end C of the paper money A reaches the shaft 82*c* supporting the reverse-pull prevention lever 82 as shown in FIG. 9.

Figure 9:
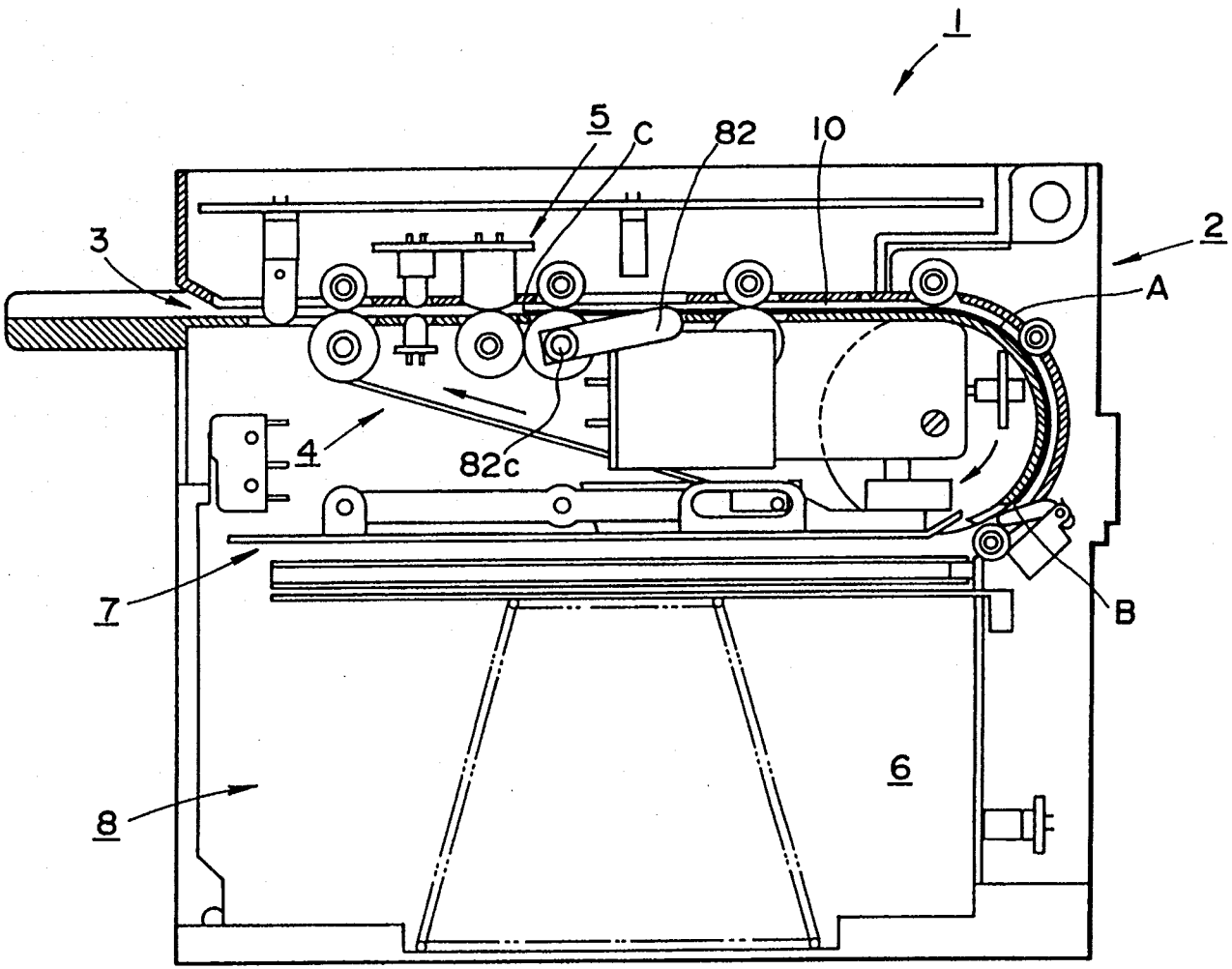
FIG. 9 is a side view similar to FIG. 1 for explaining the operation of the embodiment of FIG. 1 when the shutter switch and a money passage detection switch in FIG. 1 are in operation.
Figure 10:
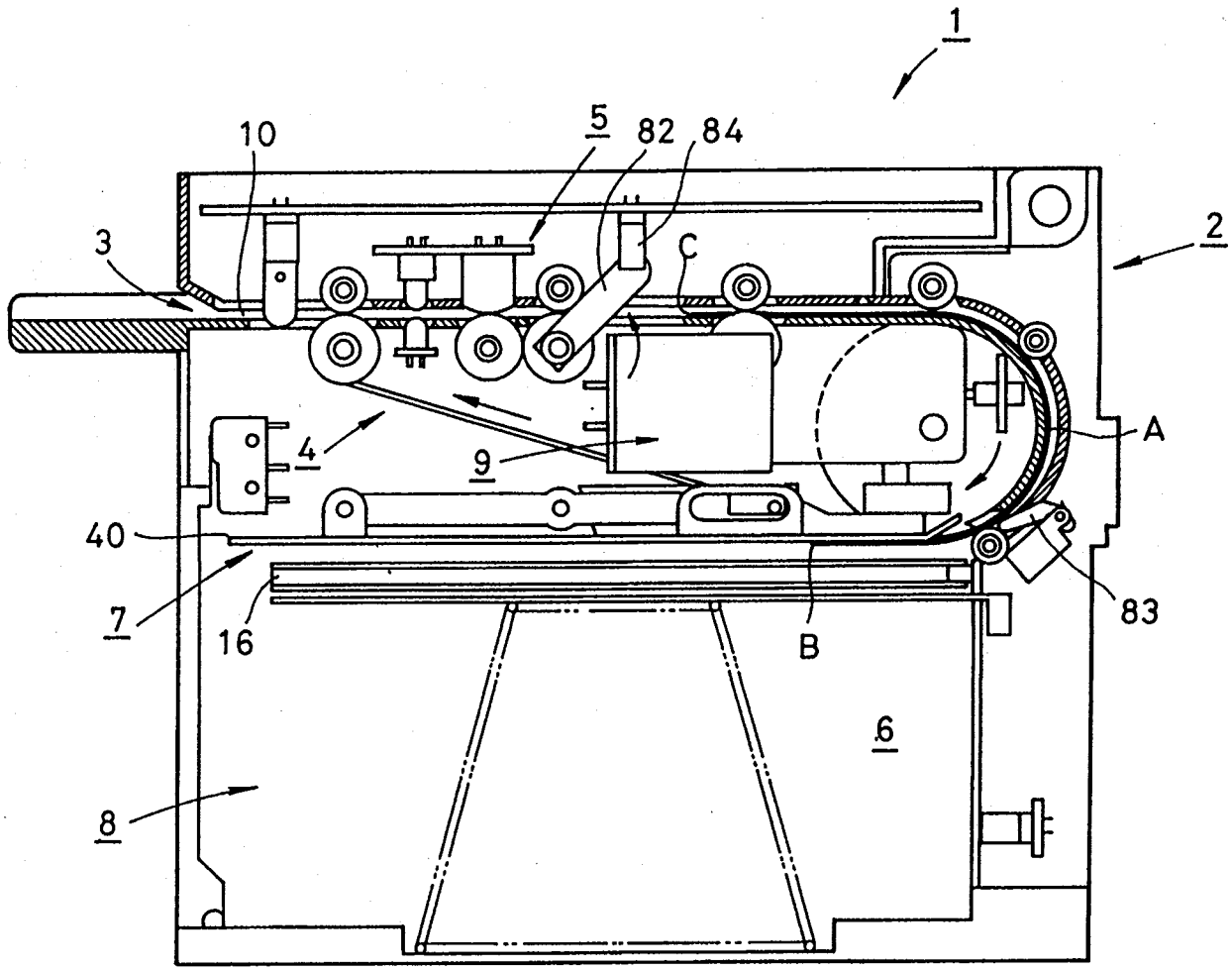
FIG. 10 is a side view similar to FIG. 1 for explaining the operation of the embodiment of FIG. 1 when only the money passage detection switch in FIG. 1 is in operation.

When it is determined on the basis of the data read out by the data reader section 5 that the paper money A is genuine at such a transportation position of the paper money A as shown in FIG. 9, the genuine-judged paper money A is further sent by the transporter section 4 downstream the paper money transportation path 10. When the leading end B of the paper money A is guided to a position between the lift table 40 of the pushing means 7 and the upper surface of the guide member 16 as shown in FIG. 10, the trailing end C of the paper money A is moved to a position downstream of the reverse-pull prevention lever 82. As a result, when the trailing end C of the paper money A arrives at such a transportation position as shown in FIG. 10, the reverse-pull prevention lever 82 is rotated in the counterclockwise direction under the influence of a resilient restoring force of a return spring (not shown) and is returned to such an initial position that blocks the paper money transportation path 10, which results in that the user cannot pull out the paper money A from such a transportation position of the paper money A as shown in FIG. 10.

Figure 11:
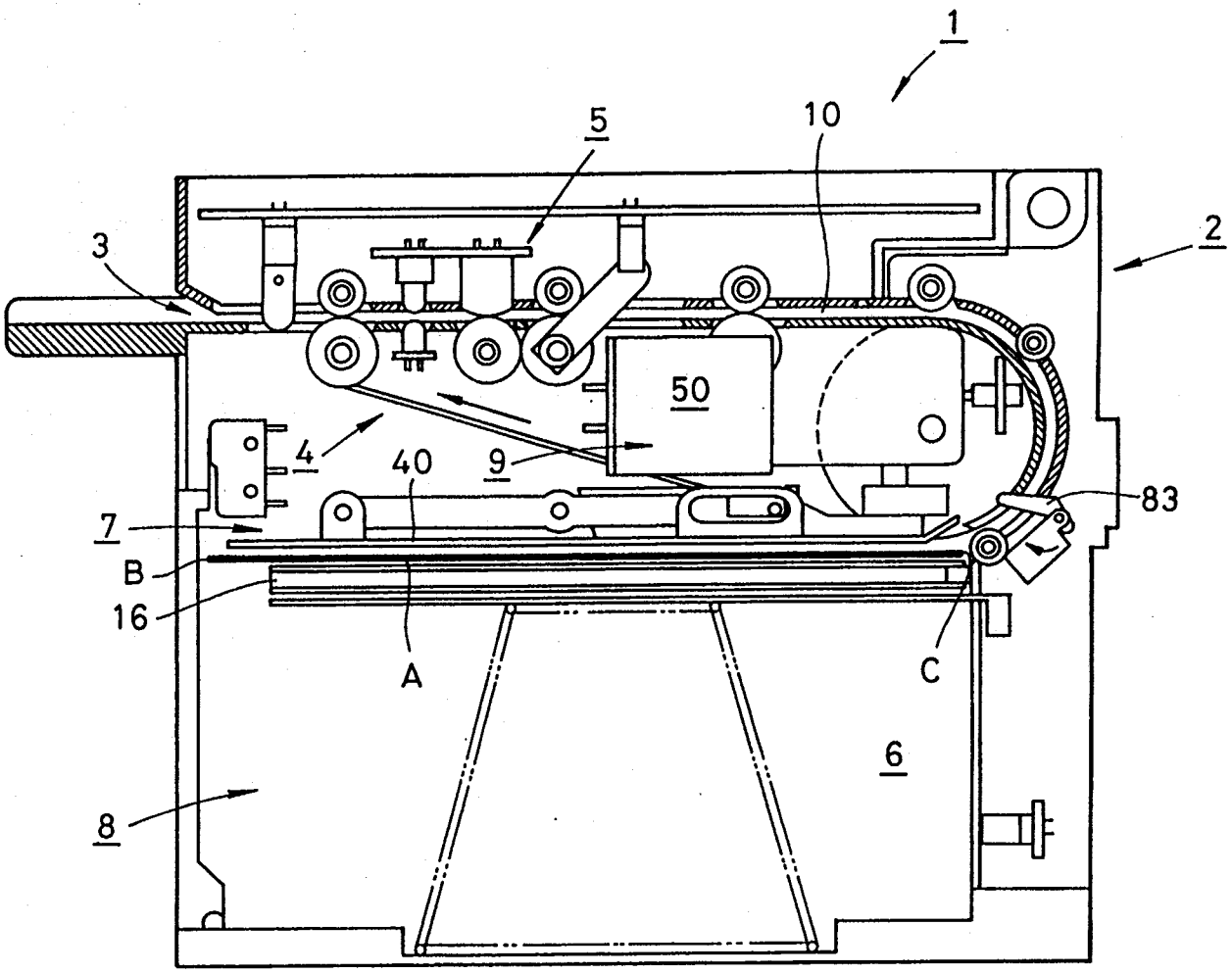
FIG. 11 is a side view similar to FIG. 1 for explaining the operation of the embodiment of FIG. 1 when a paper money reaches a stack position.

When the paper money A is further moved from its position of FIG. 10 by the paper money transporter section 4, the trailing end C of the paper money A is also guided to a position between the lift table 40 of the pushing means 7 and the upper surface of the guide member 16 as shown in FIG. 11, at which position the paper money passage lever 83 positioned at the termination end of the paper money transportation path 10 is returned to its initial position, whereby it can be detected that the leading and trailing ends B and C of the paper money A are guided to positions between the lift table 40 of the pushing means 7 and the upper surface of the guide member 16.

Figure 12:
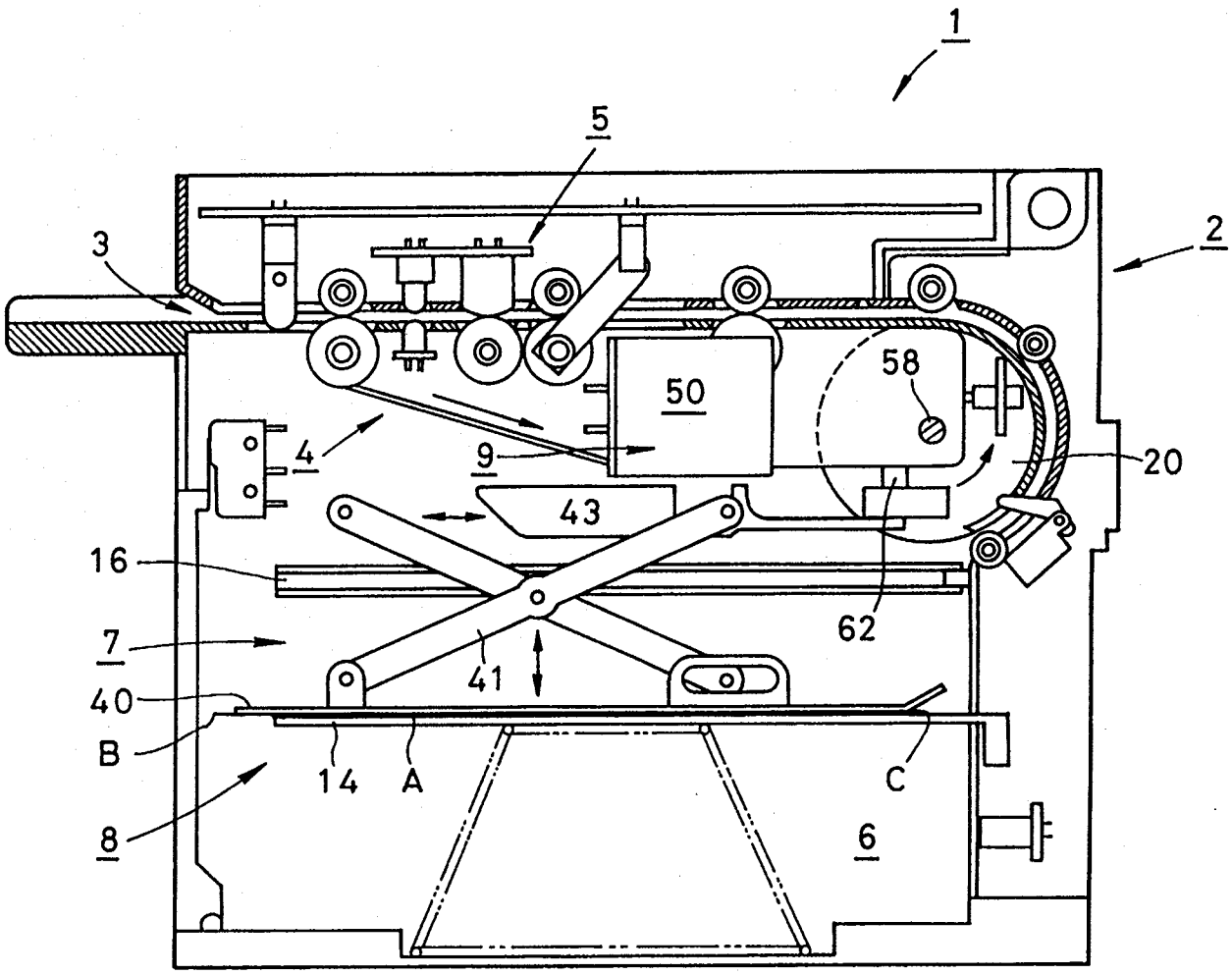
FIG. 12 is a side view similar to FIG. 1 for explaining the operation of the embodiment of FIG. 1 when the paper money stack is being stacked.
Figure 13:
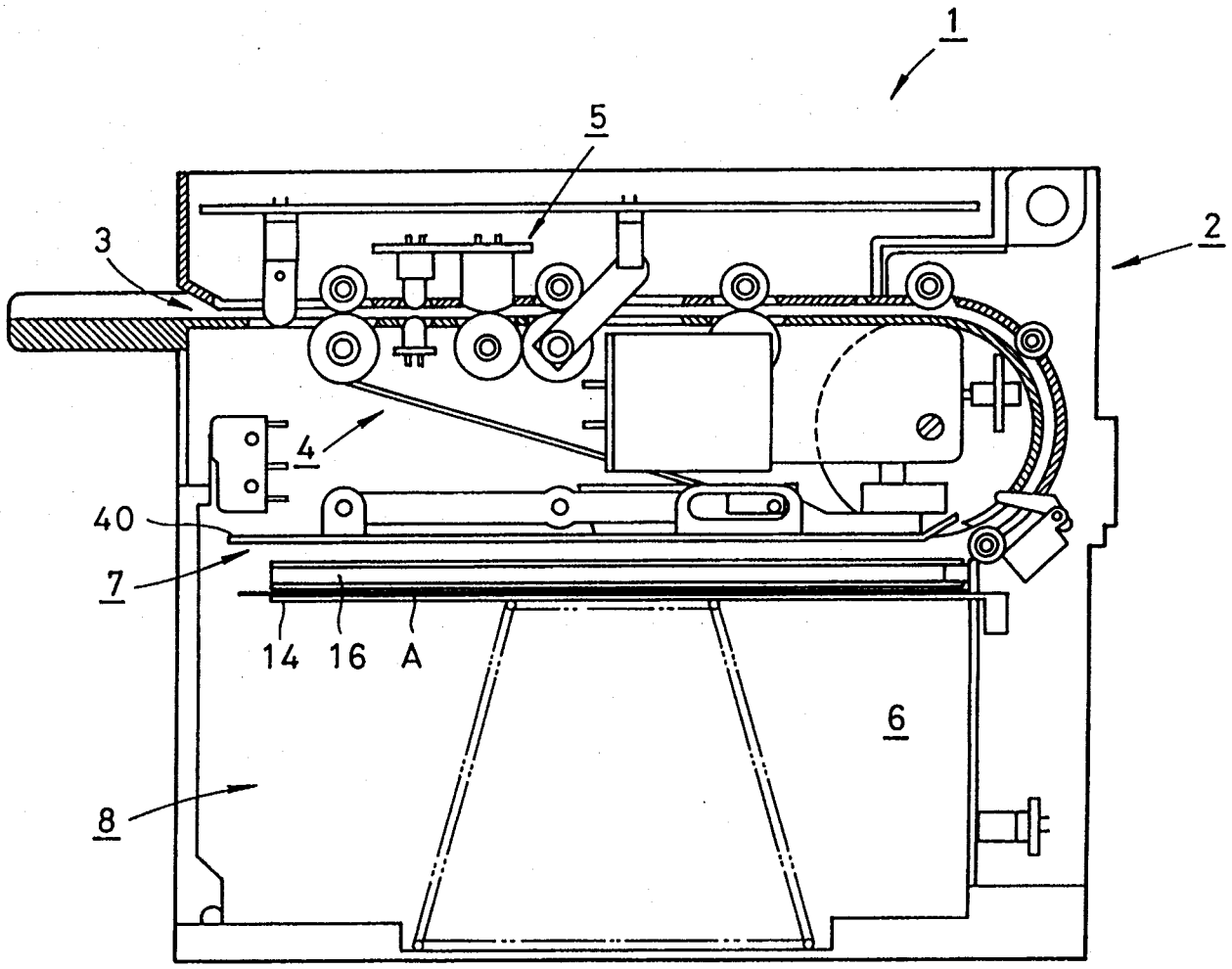
FIG. 13 is a side view similar to FIG. 1 for explaining the operation of the embodiment of FIG. 1 when the paper money stacking operation is completed.

In this way, when it is detected, on the basis of the paper money passage detection signal P2 as the output signal of the paper money passage detection switch 85 for detecting returning of the paper money passage lever 83 back to the initial position, that the trailing end C of the paper money A was passed through the position of the paper money passage lever 83 and the whole paper money A was guided to a position between the lift table 40 of the pushing means 7 and the upper surface of the guide member 16; the driving motor 50 of the driver section 9 is reversely rotated on the basis of the paper money passage detection signal P2. Thus, as shown in FIG. 12, the transportation output shaft 58 of the paper money transporter section 4 is reversely rotated to drive the driving pulley 20 in the counterclockwise direction; and at the same time, a driving force of the reversely rotated driving motor 50 is transmitted to the stack output shaft 62 through the one-way clutch 60 (see FIG. 4) to thereby rotate the stack output shaft 62 by one turn. Since one turn of the stack output shaft 62 causes one turn of the cam 44 of the slide device 42 as shown in FIGS. 2 and 3, the slider 43 performs its reciprocating movement, that is, starting from the initial position of FIG. 2, shifting to the forwardly moved position of FIG. 3 and then returning to the initial position of FIG. 2. Accordingly, as shown in FIG. 12, the link device 41 of the pantograph structure to be vertically moved up or down is driven to move the lift table 40 downwardly, so that the lift table 40 pushes the paper money A guided on the upper surface of the guide member 16 toward the lower surface of the guide member 16. And as shown in FIG. 13, when the lift table 40 is returned to the initial position, the pushed-down paper money A is kept between the lower surface of the guide member 16 and the upper surface of the stacker plate 14, that is, the paper money is accommodated within the paper money accommodation section 8.

Figure 14:
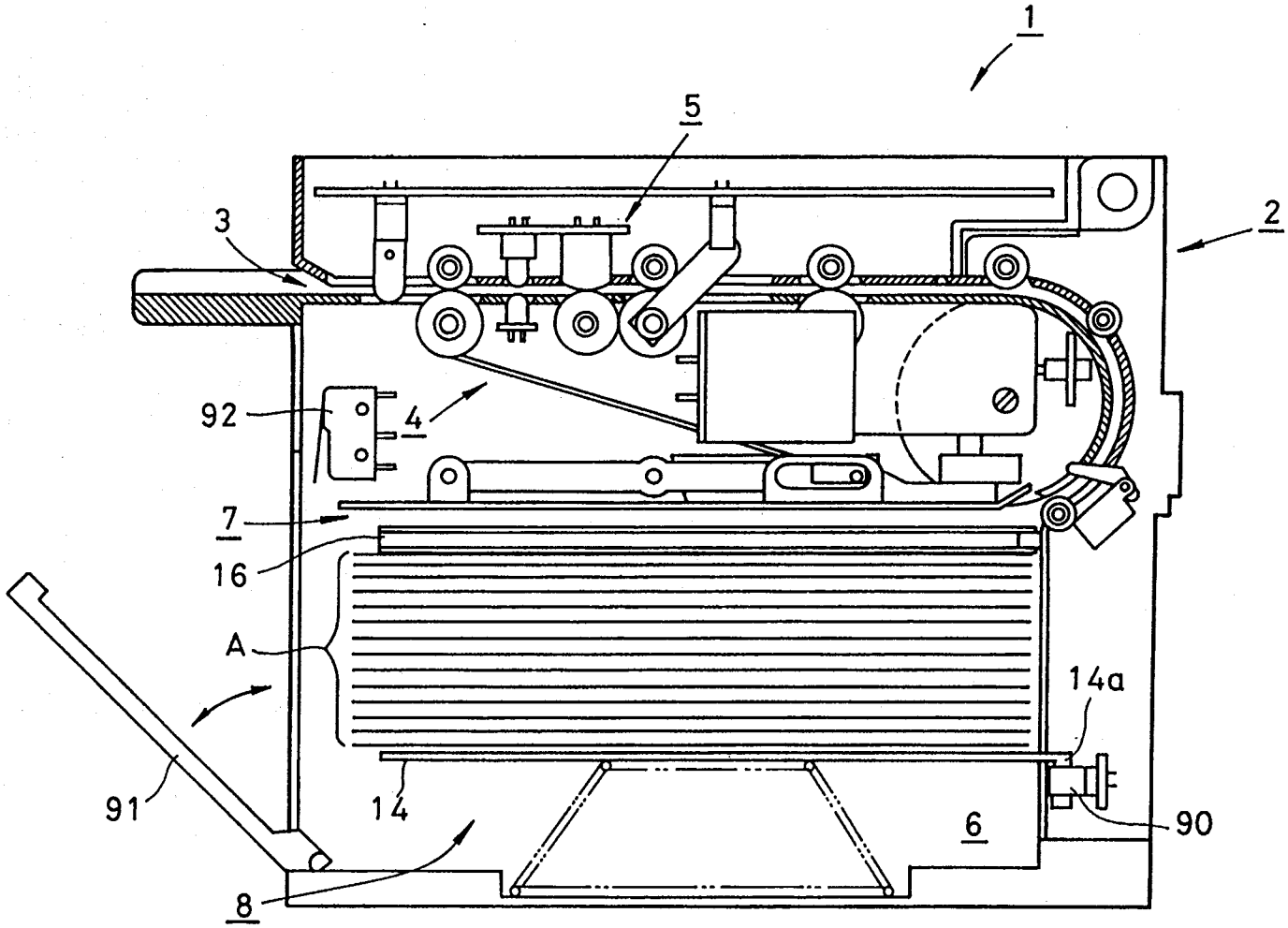
FIG. 14 is a side view similar to FIG. 1 for explaining the operation of the embodiment of FIG. 1 when the stacked paper moneys are taken out.

After the genuine-judged paper moneys A are sequentially accumulatively stacked within the paper money accommodation section 8 according to the aforementioned procedure, when the thickness of the stacked paper moneys causes the stacker plate 14 to be moved downwardly until a tongue piece 14*a* provided to the rear end of the stacker plate 14 is inserted into a fully-stacked-money detection switch 90 as shown in FIG. 14, the sensor 90 can detect such a state that the paper moneys are fully stacked and accommodated within the paper money accommodation section 8.

After the fully-stacked-money detection switch 90 detects that the paper moneys stacked in the paper money accommodation section 8 become full, the vending machine owner can open a money collection casing 91 openable from the front side of the paper money accommodation section 8 to draw out and collect the paper moneys A stacked in the paper money accommodation section 8.

Figure 15:
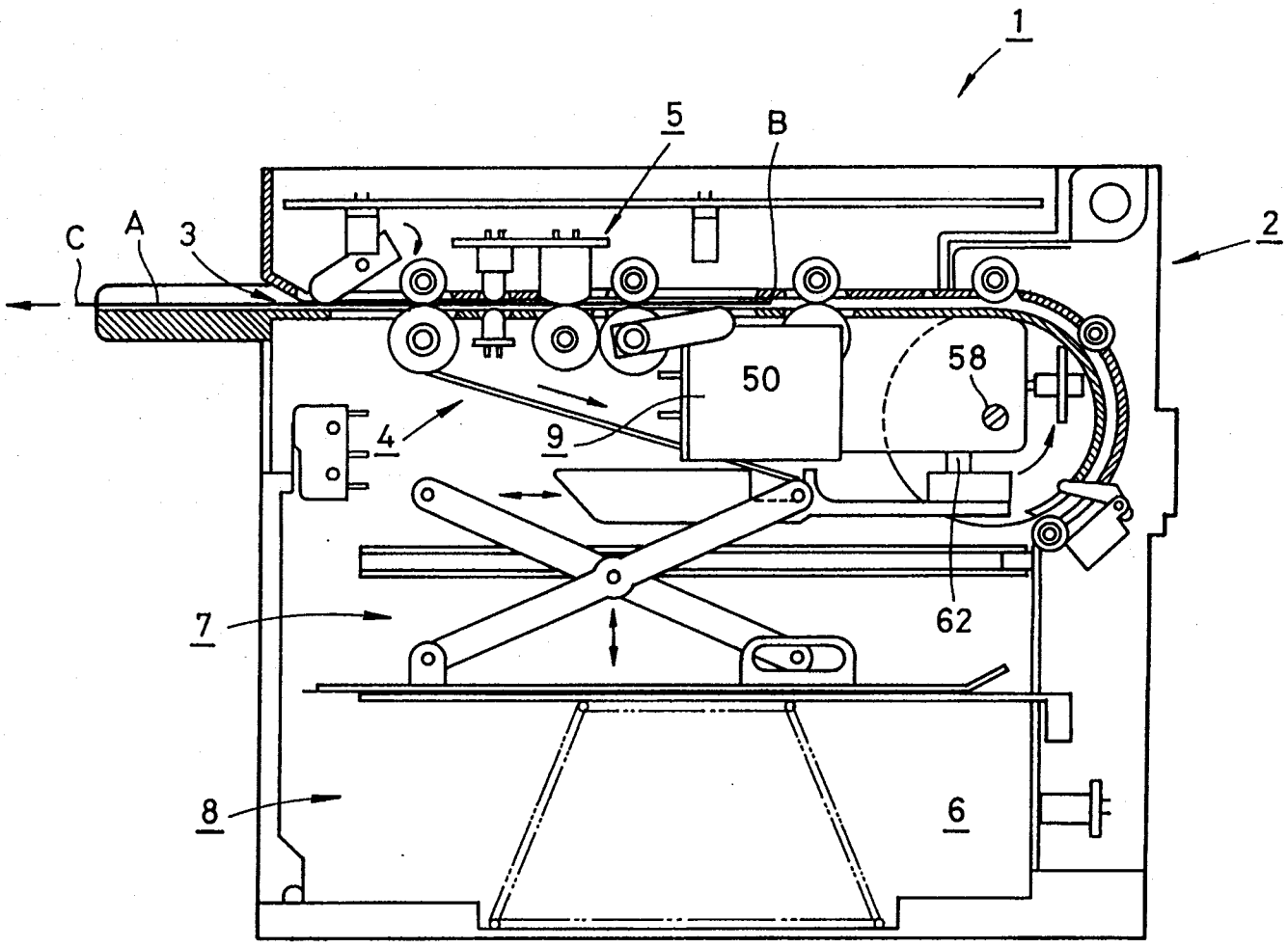
FIG. 15 is a side view similar to FIG. 1 for explaining the operation of the embodiment of FIG. 1 when an inserted paper money is in its repayment operation.

Meanwhile, the leading end B of the paper money A transported along the transportation path 10 causes a reverse-pull prevention lever 82 to be pivoted in its clockwise direction whereby the paper money A is further transported as shown in FIG. 8. The determination is made whether the paper money A is genuine or not on the basis of the Optical data and the magnetic data read out by the data reader section 5 during a period until the trailing end C of the paper money A reaches the shaft 82*c* supporting the reverse-pull prevention lever 82 as shown in FIG. 9. When it is determined on the basis of the output of the data reader section 5 that the paper money A is false, a decision signal issued from the data reader section 5 causes the driving motor 50 of the driver section 9 to be reversely rotated as shown in FIG. 15, so that the transportation output shaft 58 of the paper money transporter section 4 is rotated counterclockwise to return the false-determined paper money A from the paper money insert slot 3.

At this time, since the driving motor 50 is reversely driven, its rotating torque is transmitted also to the stack output shaft 62 through the one-way clutch 60 (see FIG. 4), whereby the pushing means 7 of the paper money accommodation section 8 is driven to carry out the stack operation.

Figure 16:
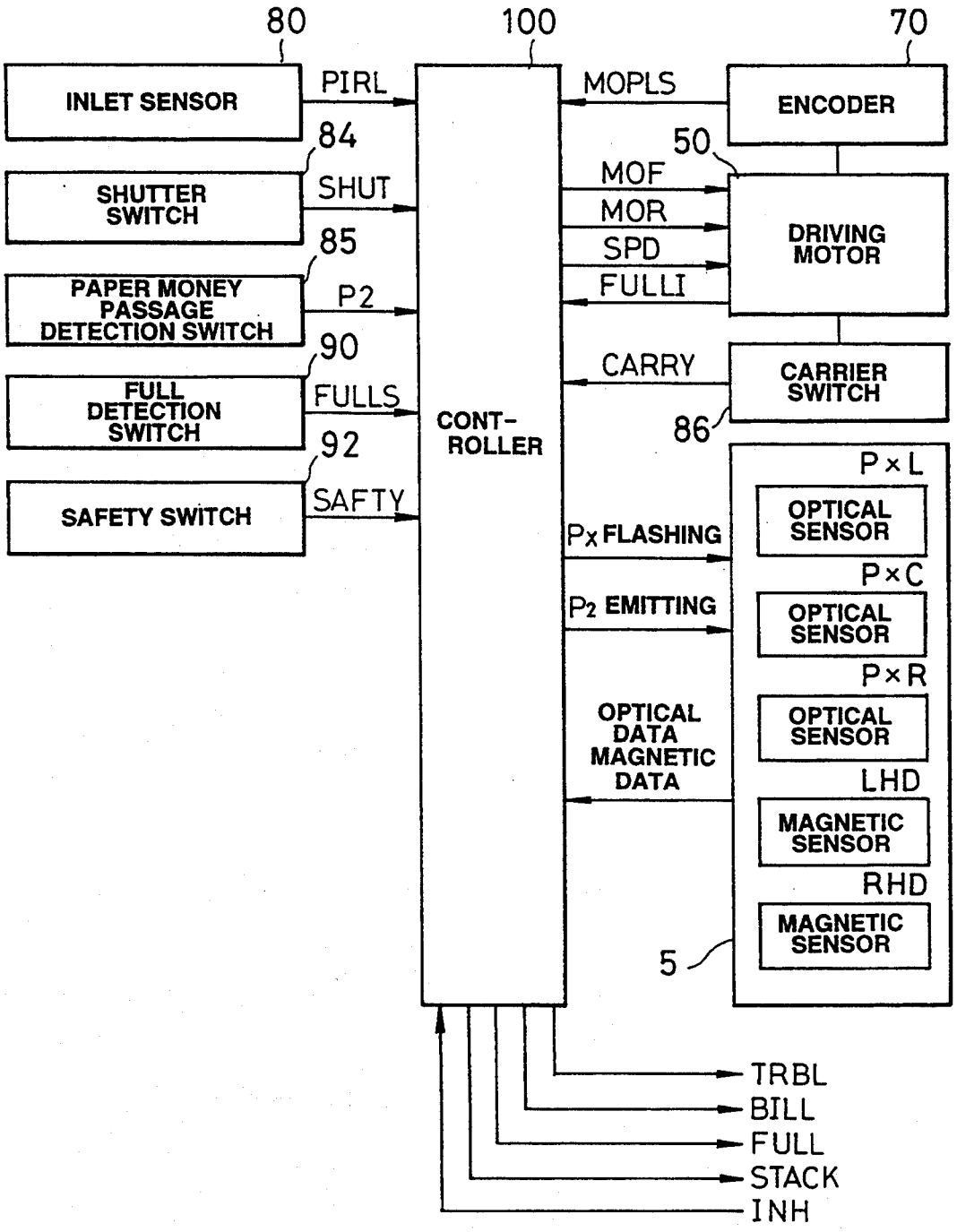
FIG. 16 is a block diagram of an arrangement of a control device in the embodiment of FIG. 1.

Shown in FIG. 16 is a block diagram of a control device in the paper money processor of the present embodiment. The control device of FIG. 16 comprises, as its main constituent elements, a controller 100 forming a microcomputer.

The controller 100 receives the inlet sensor signal PIRL from the inlet sensor 80 as its output, the shutter signal SHUT from the shutter switch 84 as its output, the paper money passage detection signal P2 from the paper money passage detection switch 85 as its output, the fully-stacked-money detection signal FULLS from the fully-stacked-money detection switch 90 as its output, the safety signal SAFTY from the safty switch 92 as its output, the motor pulse MOPLS from the encoder 70 as its output, the carrier signal CARRY from the carrier switch 86 as its output, a fully-stacked-money current detection signal FULLI detected from a driving current of the driving motor 50 in the stacking operation, and decision data received from the data reader section 5 as its output. The fully-stacked-money current detection signal FULLI has a level of "1" in the fully-stacked-money detection state and otherwise a level of "0".

The controller 100 generates, on the basis of the aforementioned input signals, a motor forward drive signal MOF, a motor reverse drive signal MOR and a constant-voltage control signal SPD for control of the driving motor 50; and outputs the motor forward and reverse drive signals MOF and MOR and constant-voltage control signal SPD to the driving motor 50. The motor forward drive signal MOF has a level of "1" when the driving motor 50 is forwardly driven and a level of "0" when the motor is stopped; the motor reverse drive signal MOR has a level of "1" when the driving motor 50 is reversely driven and a level of "0" when the motor is stopped; and the constant-voltage control signal SPD has a level of "1" in the constant-voltage control of the motor and otherwise a level of "0".

The data reader section 5 includes the three optical sensors PxL, PxC and PxR and the two magnetic sensors LHD and RHD, as already explained above. The controller 100, based on the aforementioned input signals, generates control signals for control of light emission and flashing of the optical sensors PxL, PxC and PxR, outputs the control signals to the data reader section 5 and receives optical data detected by the optical sensors PxL, PxC and PxR as well as magnetic data detected by the magnetic sensors LHD and RHD.

The controller 100, on the basis of the various signals received from the aforementioned parts and an acceptance inhibition signal INH received from an external device (not shown), also generates an abnormality signal TRBL, a genuine bill signal BILL, a fully-stacked-money signal FULL and a money collection confirmation signal STACK; and outputs these signals to the external device (not shown). The acceptance inhibition signal INH, when having a level "0", indicates an acceptance inhibition state; the abnormality signal TRBL, when having a level "1" indicates an abnormal state; the genuine bill signal BILL, when having a level "1", indicates that the bill is true; the fully-stacked-money signal FULL, when having a level "1", indicates a state of fully stacked bills; and the money collection confirmation signal STACK, when having a level of "1" indicates a money collection confirmation state Explanation will next be made as to the detailed operation of the above controller 100 by referring to flowcharts of FIGS. 17 to 41.

Operation when power is turned ON:

FIGS. 17 to 20 show the operation of the paper money processor of the present embodiment when its power is turned ON. When the power is turned ON, the controller checks the safty signal SAFTY, fully-stacked-money detection signal FULLS, inlet sensor signal PIRL, paper money passage detection signal P2, shutter signal SHUT and motor pulse MOPLS, and when finding an abnormality therein, outputs the abnormality signal TRBL to the external device. In this case, if a paper money is present in the paper money processor, then the controller shifts to its repayment operation to return the paper money.

Figure 17:
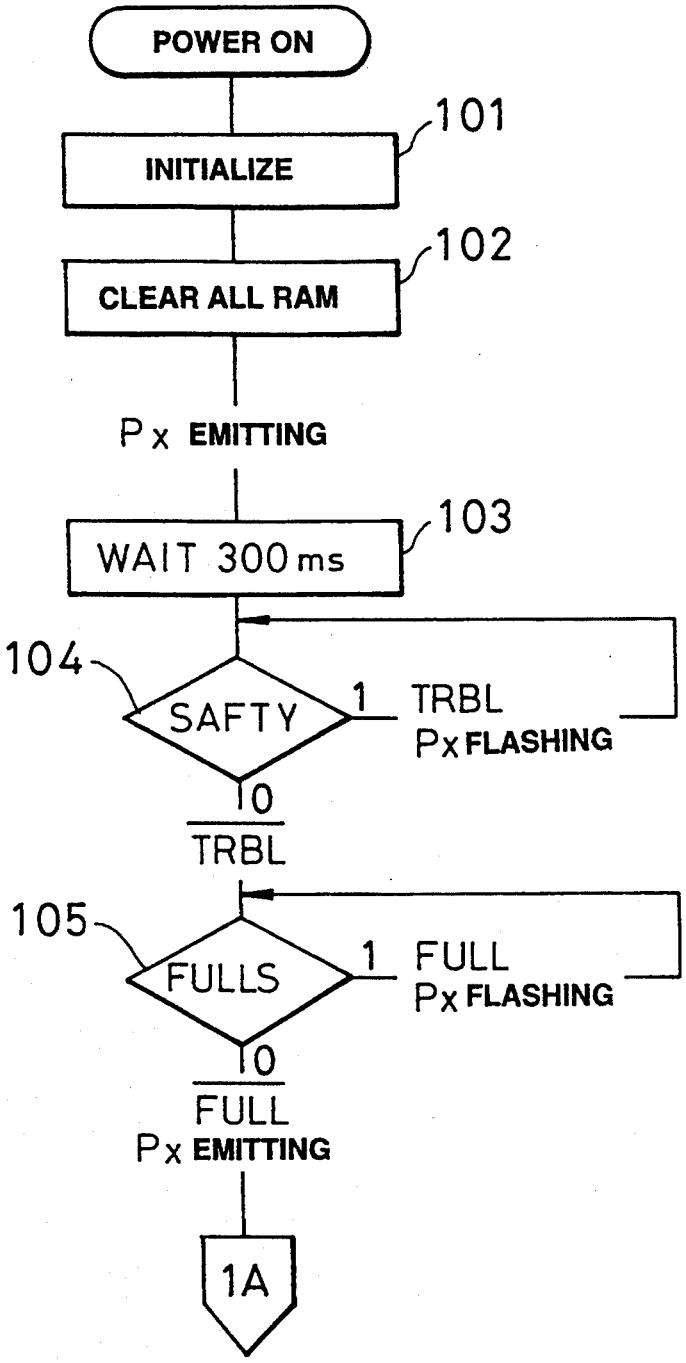
FIGS. 17, 18, 19 and 20 collectively show a flowchart showing the operation of the controller of FIG. 16 in its power ON mode.

In FIG. 17, when the power is turned ON, this causes the controller 100 to perform its predetermined initializing operation over the respective parts thereof (step 101) and then to clear all a random access memory RAM (not shown) in the controller (step 102).

The controller 100 next outputs a control signal indicative of turning ON of emission of the optical sensors PxL, PxC and PxR of the data reader section 5 turn ON the optical sensors PxL, PxC and PxR for their light emission. Thereafter, the controller waits for a time of 300 msec. (step 103) and then examines the safty signal SAFTY received from the safty switch 92 (step 104). When the controller determines that the salty signal SAFTY has a level of "1", which means that the bill collection cover 91 is in its open state, the controller judges an abnormality and sets the abnormality signal TRBL at "1" to control the optical sensors PxL, PxC and PxR of the data reader section 5 in their emission flashing state, and returns to the step 104. The present embodiment is arranged so that, in a wait mode where no paper money is accepted, the optical sensors PxL, PxC and PxR are controlled to be put in their emission flashing state. This is because of prolongation of the operational life of these optical sensors. Thus, the present embodiment is arranged so that, only when the paper money processor accepts a paper money, the optical sensors PxL, PxC and PxR of the data reader 5 are put in the light emission state. Although the optical sensors PxL, PxC and PxR are put in the emission flashing state in the wait mode in the present embodiment, the optical sensors may be put in the emission turn-OFF state in the wait mode as necessary.

When determining in the step 104 that the safty signal SAFTY has a level of "0", the controller examines the fully-stacked-money detection signal FULLS received from the fully-stacked-money detection switch 90 (step 105). When the controller determines that the fully-stacked-money detection signal FULLS has a level of "1" this means that the number of bills accommodated as stacked within the paper money accommodation box 6 exceeds a predetermined value. In this case, the controller sets the fully-stacked-money signal FULL at "1" to control the optical sensors PxL, PxC and PxR of the data reader section 5 in the emission flashing state, and returns to the step 105.

Figure 18:
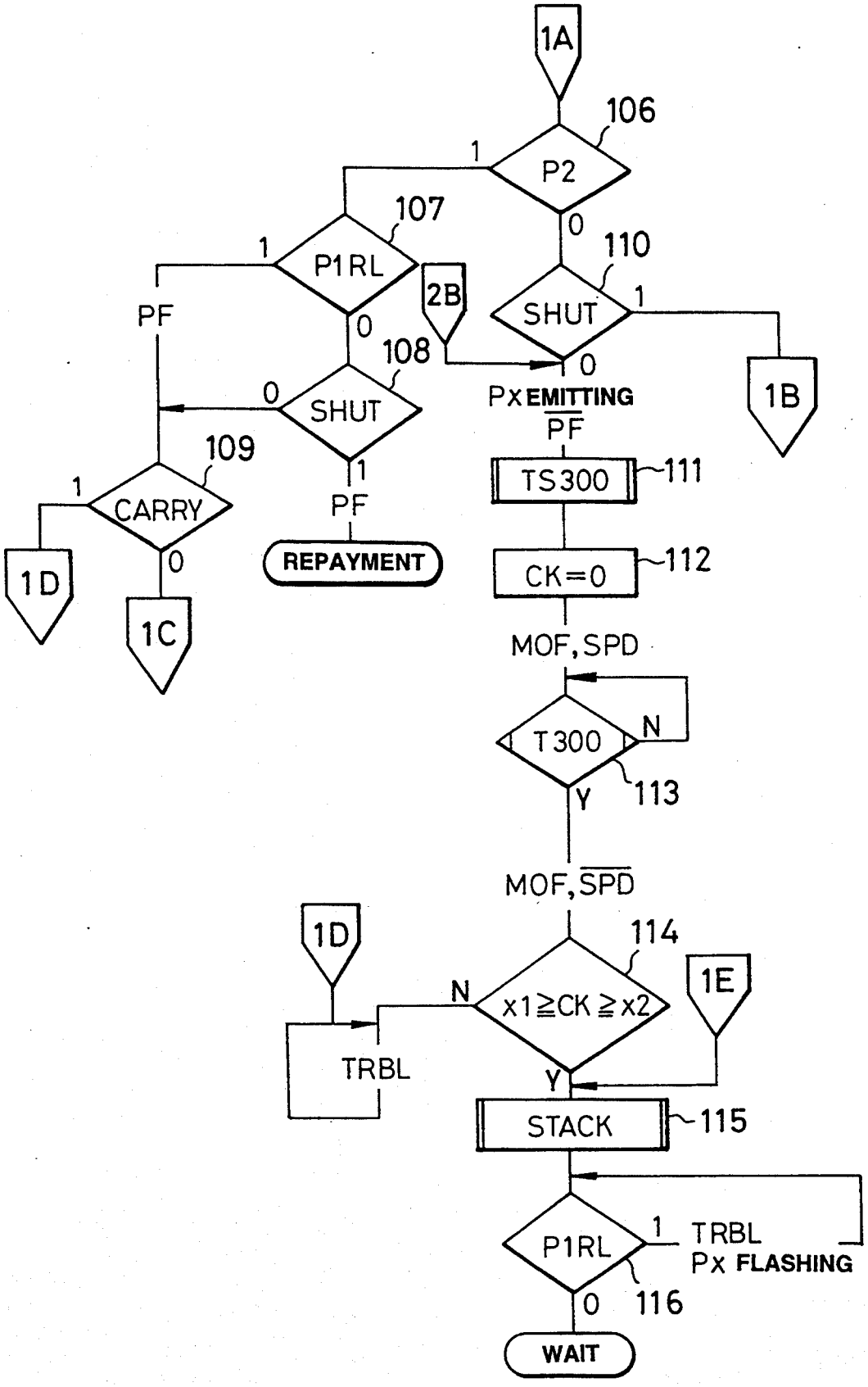

When determining in the step 105 that the fully-stacked-money detection signal FULLS has a level of "0", the controller sets the fully-stacked-money signal FULL at "0" to put the optical sensors PxL, PxC and PxR in the light emission state, and shifts to the flowchart of FIG. 18 to examine the paper money passage detection signal P2 received from the paper money passage detection switch 85 (step 106). When determining that the paper money passage detection signal P2 has a level of "0", the controller next examines the shutter signal SHUT received from the shutter switch 84 (step 110). Determination of the shutter signal SHUT having a level of "0" causes the controller to put the optical sensors PxL, PxC and PxR in the light emission state, and to set a power flag PF at "0" to start a 300 msec. timer (step 111). And the controller clears to zero a counted value CK of the motor pulse MOPLS received from the encoder 70 (step 112), sets at "1" the motor forward drive signal MOF to be applied to the driving motor 50, and also sets the constant-voltage control signal SPD at "1". As a result, the driving motor 50 is driven in the forward direction.

Next, the controller examines whether or not the 300 msec. timer started in the step 111 timed out (step 113). When failing to find the time out, the controller returns to the step 113; while, when finding the time out, the controller sets the motor forward drive signal MOF at "0", sets the constant-voltage control signal SPD at "0", and then examines whether or not the counted value CK of the motor pulse MOPLS is within a range between predetermined values x1 and x2, i.e., whether or not a relationship $x1 \geqq CK \geqq x2$ is satisfied (step 114). When the relationship $x1 \geqq CK \geqq x2$ is not satisfied, the controller judges an abnormality and sets the abnormality signal TRBL at "1".

When determining in the step 114 that the relationship $x1 \geqq CK \geqq x2$ is satisfied, the controller performs its starting operation to be explained later (step 115) and then examines the inlet sensor signal PIRL (step 116). When determining that the inlet sensor signal PIRL has a level of "0", the controller is put in the wait state. However, when determining in the step 116 that the inlet sensor signal PIRL has a level of "1", the controller judges an abnormality, sets the abnormality signal TRBL at "1" to put the optical sensors PxL, PxC and PxR in the emission flashing state, and returns to the step 116.

Figure 19:
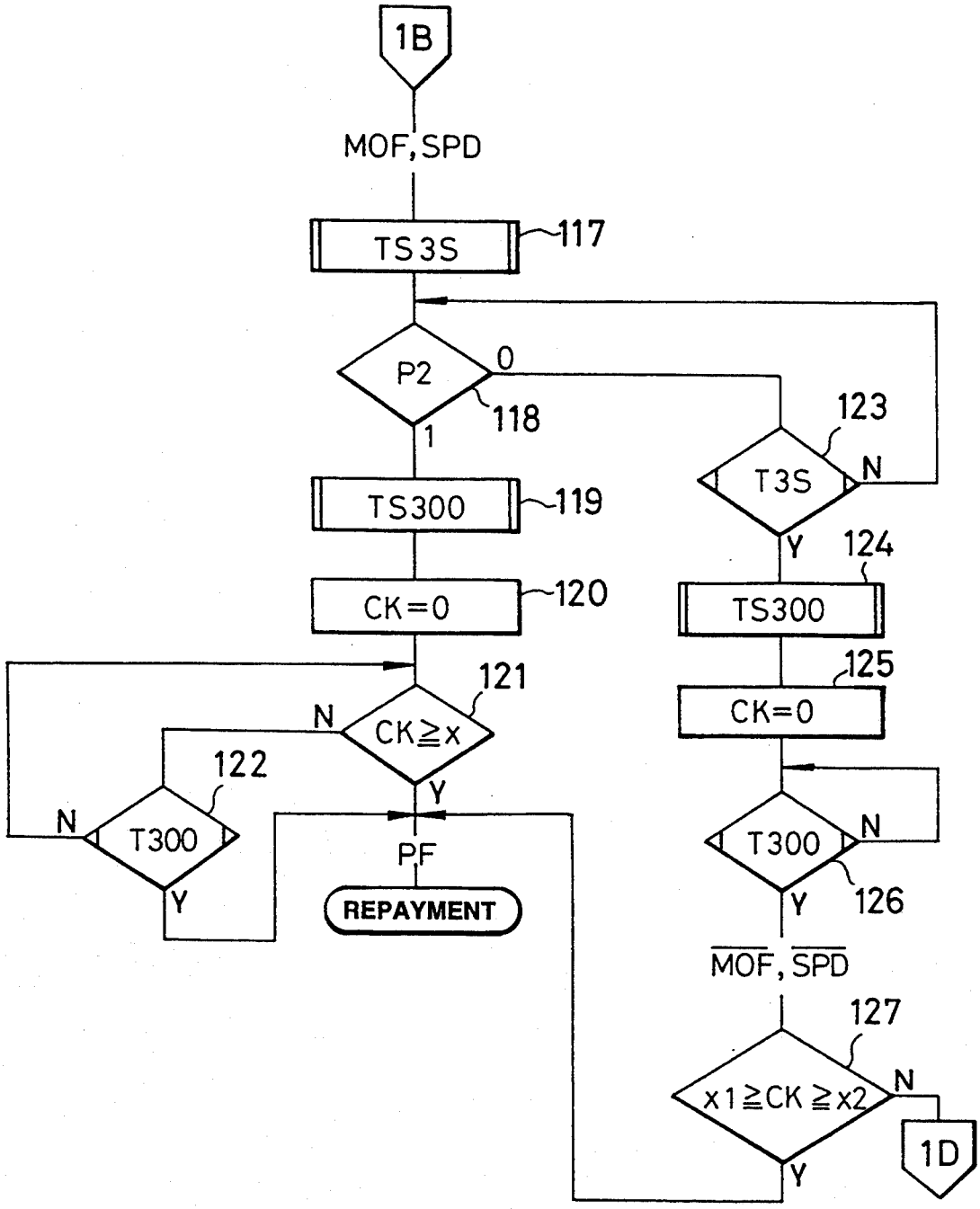

When determining in the step 110 that the shutter signal SHUT has a level of "1", the controller shift to the flowchart of FIG. 19. In the flowchart of FIG. 19, the controller first sets the motor forward drive signal MOF at "1", sets the constant-voltage control signal SPD at "1" to forwardly drive the motor 50, starts a 3 sec. timer (step 117), and then examines the paper money passage detection signal P2 (step 118). When the paper money passage detection signal P2 has a level of "1", the controller starts the 300 msec. timer (step 119) and clears the counted value CK of the motor pulse MOPLS to zero (step 120). And the controller examines whether or not the counted value CK of the motor pulse MOPLS is larger than a predetermined value x, that is, whether or not a relationship CK≧x is satisfied (step 121). When the relationship CK≧x is satisfied, the controller sets the power flag PF at "1" and shifts to its repayment operation to be explained later.

When determining in the step 121 that the relationship CK≧x is not satisfied, the controller examines whether or not the 300 msec. timer started in the step 119 expired or timed out (step 122). When failing to find the time out, the controller returns to the step 121; while when finding the time out, the controller sets the power flag PF at "1" and shifts to the repayment operation to be described later.

When determining in the step 118 that the paper money passage detection signal P2 has a level of "0", the controller examines whether or not the 3 sec. timer started in the step 117 timed out (step 123). When the 3 sec. timer did not expire yet, the controller returns to the step 118; while, when the 3 sec. timer expired, the controller starts the 300 msec. timer (step 124) and clears the counted value CK of the motor pulse MOPLS to zero (step 125). The controller next examines whether or not the 300 msec. timer started in the step 124 expired (step 126). When the 300 msec. timer expired, the controller sets the motor forward drive signal MOF at "0" sets the constant-voltage control signal SPD at "0", and examines whether or not the counted value CK of the motor pulse MOPLS is within the range between the predetermined values x1 and x2, that is, whether or not the relationship x1≧CK≧x2 is satisfied (step 127). When the relationship x1≧CK≧x2 is not satisfied, the controller Goes to the flowchart of FIG. 18 and sets the abnormality signal TRBL at "1". When determining in the step 127 that the relationship x1≧CK≧x2 is satisfied, the controller sets the power flag PF at "1" and shifts to the repayment operation to be described later.

When determining in the step 106 of the flowchart of FIG. 18 that the paper money passage detection signal P2 has a level of "1", the controller examines the inlet sensor signal PIRL issued from the inlet sensor 80 (step 107). When the inlet sensor signal PIRL has a level of "0", the controller then examines the shutter signal SHUT issued from the shutter switch 84 (step 108). When the shutter signal has a level of "1", the controller sets the power flag PF at "1" and shifts to the repayment operation to be described later.

When determining in the step 107 that the inlet sensor signal PIRL has a level of "1", the controller sets the power flag PF at "1" and examines the carrier signal CARRY issued from the carrier switch 86 (step 109). When the carrier signal CARRY has a level of "1", the controller judges the presence of an abnormality and sets the abnormality signal TRBL at "1". When determining in the step 109 that the carrier signal CARRY has a level of "0", the controller shifts to the flowchart of FIG. 20.

Figure 20:
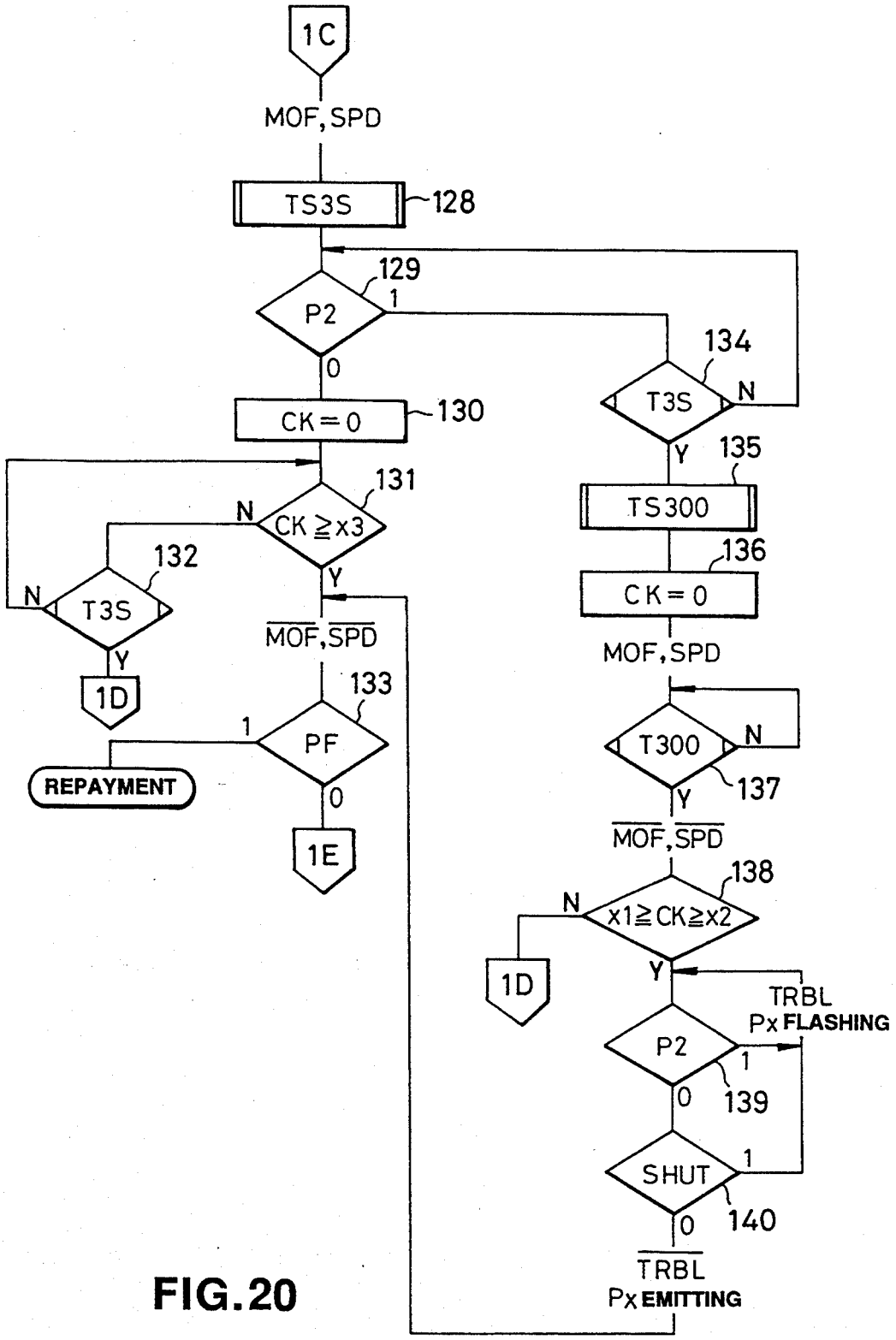

In the flowchart of FIG. 20, the controller first sets the motor forward drive signal MOF at "1", and sets the constant-voltage control signal SPD at "1" to forwardly drive the driving motor 50 and start the 3 sec. timer (step 128). Next, the controller examines the paper money passage detection signal P2 (step 129). When the paper money passage detection signal P2 has a level of "0", the controller clears the counted value CK of the motor pulse MOPLS to zero (step 130) and examines whether or not the counted value CK is larger than a predetermined value x3, i.e., whether or not a relationship CK≧x3 is satisfied (step 131). When the relationship CK≧x3 is not satisfied, the controller examines whether or not the 3 sec. timer started in the step 128 expired (step 132). When the 3 sec. timer did not expire, the controller returns to the step 131; while, when the 3 sec. timer expired, the controller shifts to the flowchart of FIG. 18 and sets the abnormality signal TRBL at "1".

When determining in the step 131 that the relationship CK≧x3 is satisfied, the controller sets the motor forward drive signal MOF at "0", sets the constant-voltage control signal SPD at "0" to stop the driving motor 50, and then examines the power flag PF (step 133). When the power flag PF has a level of "1", the controller shifts to the repayment operation to be described later. When the power flag PF has a level of "0", the controller shifts to the step 115 of FIG. 18.

When determining in the step 129 that the paper money passage detection signal P2 has a level of "1", the controller next examines whether or not the 3 sec. timer started in the step 128 expired (step 134). When the 3 sec. timer did not expire yet, the controller returns to the step 129; while, when the 3 sec. timer expired, the controller starts the 300 msec. timer (step 135) and clears the counted value CK of the motor pulse MOPLS to zero (step 136). And the controller sets the motor forward drive signal MOF at "1", sets the constant-voltage control signal SPD at "1" to forwardly drive the motor 50, and examines whether or not the timer started in the step 135 expired (step 137). When the timer did not expire yet, the controller returns to the step 137; while when the timer expired, the controller sets the motor forward drive signal MOF at "0", sets the constant-voltage control signal SPD at "0", and then examines whether or not the counted value CK of the motor pulse MOPLS is within the range of the predetermined values x1 and x2, i.e., whether or not the relationship x1≧CK≧x2 is satisfied (step 138). When the relationship x1≧CK≧x2 is not satisfied, the controller shifts to the flowchart of FIG. 18, judges the presence of an abnormality, and sets the abnormality signal TRBL at "1".

When determining in the step 138 that the relationship x1≧CK≧x2 is satisfied, the controller examines the paper money passage detection signal P2 (step 139). When the paper money passage detection signal P2 has a level of "1", the controller judges the presence of an abnormality, sets the abnormality signal TRBL at "1" controls the optical sensors PxL, PxC and PxR in the emission flashing state, and then returns to the step 139.

When determining in the step 139 that the paper money passage detection signal P2 has a level of "0", the controller next examines the shutter signal SHUT (step 140). When the shutter signal SHUT has a level of "1", the controller judges the presence of an abnormality, sets the abnormality signal TRBL at "1", controls the optical sensors PxL, PxC and PxR in the emission flashing state, and returns to the step 139.

When determining in the step 140 that the shutter signal SHUT has a level of "0", the controller sets the abnormality signal TRBL at "0", controls the optical sensors PxL, PxC and PxR in the light emission state, sets the motor forward drive signal MOF at "0", sets the constant-voltage control signal SPD at "0", and shifts to the step 133.

Figure 21:
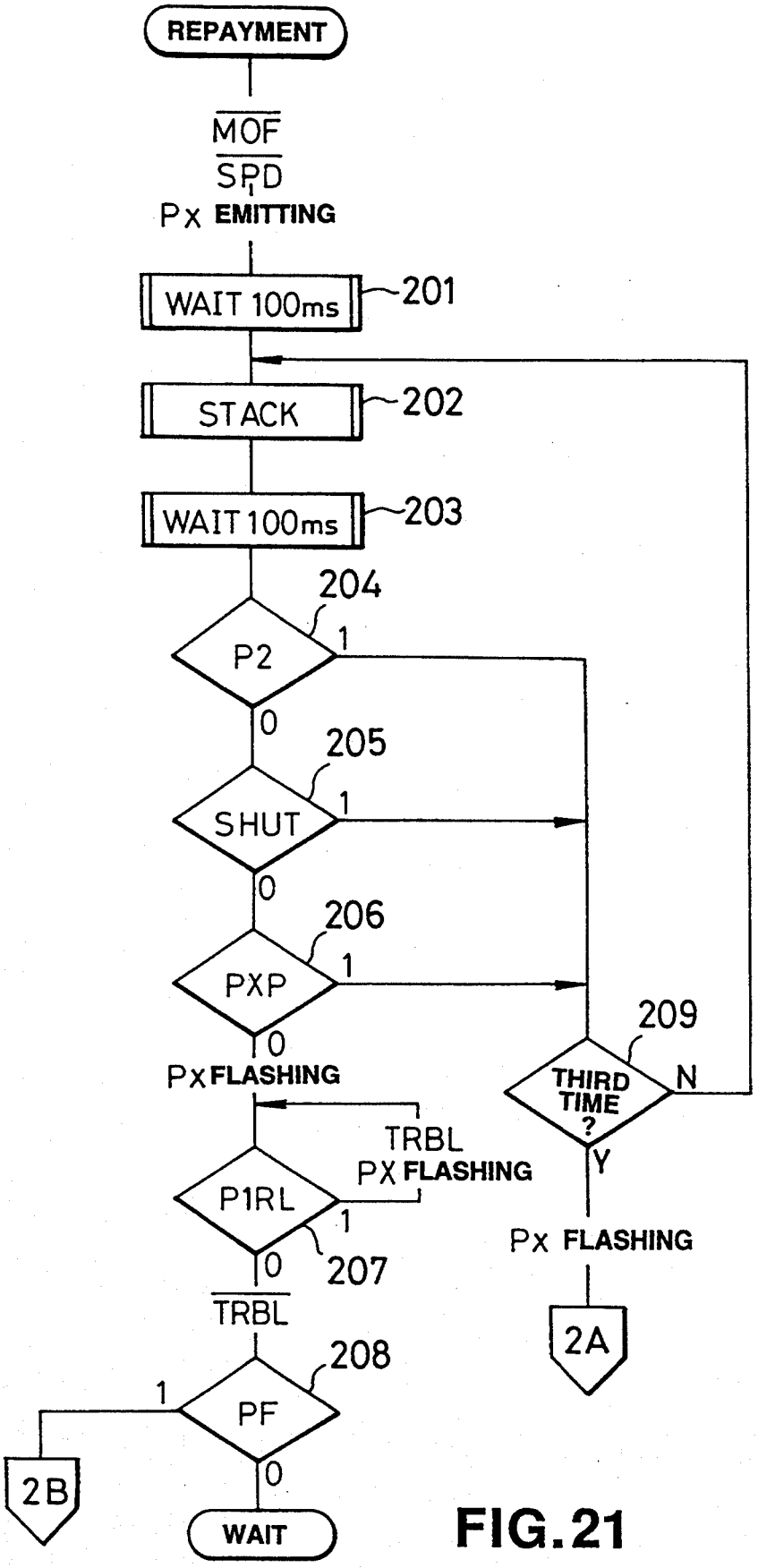
FIGS. 21 and 22 collectively show a flowchart showing the operation of the controller of FIG. 16 in its repayment mode.
Figure 22:
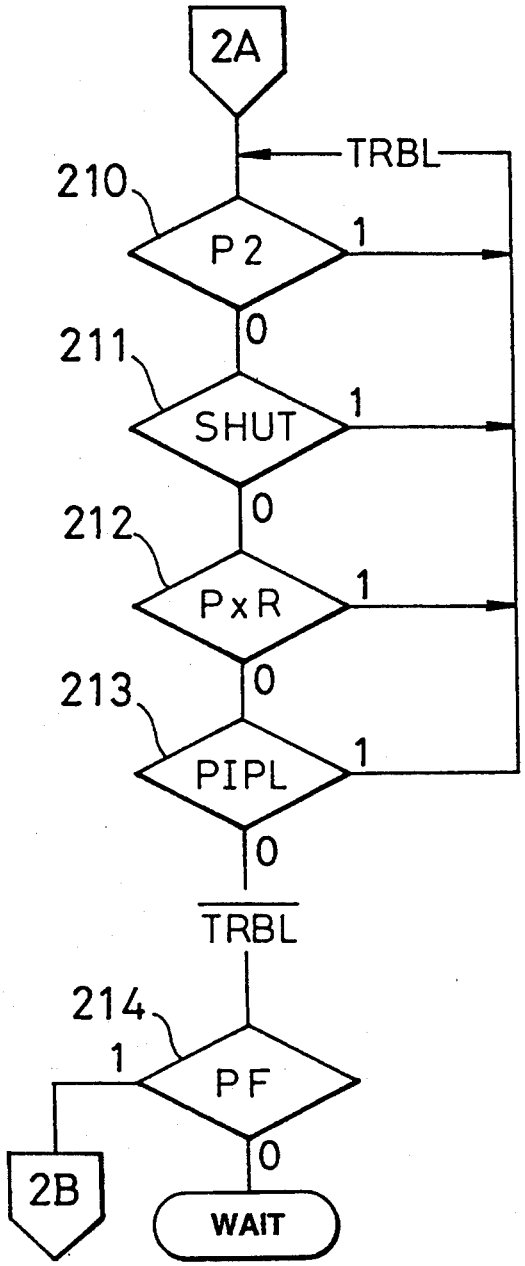

Repayment operation:

FIGS. 21 and 22 show the repayment operation. In the repayment operation, when the driving motor 50 is reversely driven, the inserted paper money within the paper money processor is returned from the paper money insert slot 3.

In FIG. 21, the controller first sets the motor forward drive signal MOF at "0", sets the constant-voltage control signal SPD at "0", and sets the optical sensors PxL, PxC and PxR in the light emission state. And the controller waits for a time of 100 msec. (step 201) and performs its stacking operation (step 202). In the stacking operation, the driving motor 50 is reversely driven to rotate the transportation output shaft 58 of the paper money carrier section 4 in the counterclockwise direction and to return the paper money within the paper money processor from the paper money insert slot 3, which will be described later.

After completing the processing of the step 202, the controller waits for a time of 100 msec. (step 203) and examines the outputs of the paper money passage detection signal P2, shutter signal SHUT and optical sensor PxR (steps 204, 205 and 206). When the output of the optical sensor PxR is compared with a predetermined threshold value and larger than the threshold value, the controller processes the output of the optical sensor PxR regarded as having a level of "1". When the output of the optical sensor PxR is smaller than the threshold value, the controller processes the output of the optical sensor PxR regarded as having a level of "0".

When determining in the steps 204, 205 and 206 that the paper money passage detection signal P2, shutter signal SHUT and optical sensor PxR have a level of "0" respectively, the controller sets the optical sensors PxL, PxC and PxR in the emission flashing state and then examines the inlet sensor signal PIRL (step 207). When the inlet sensor signal PIRL has a level of "1", the controller judges the presence of an abnormality, sets the abnormality signal TRBL at "1", sets the optical sensors PxL, PxC and PxR in the emission flashing state, and returns to the step 207.

When determining in the step 207 that the inlet sensor signal PIRL has a level of "0", the controller sets the abnormality signal TRBL at "0" and then examines the power flag PF (step 208). When the power flag PF has a level of "0", the controller enters into its wait state. When determining in the step 208 that the power flag PF has a level of "1", however, the controller shifts to the flowchart of FIG. 18, sets the optical sensors PxL, PxC and PxR in the light emission state, sets the power flag PF at "0", and performs the operations of the step 111 and subsequent steps.

When determining in the steps 204, 205 and 206 that any of the paper money passage detection signal P2, shutter signal SHUT and optical sensor PxR has a level of "1", the controller examines whether or not the current state is the third time (step 209). If the current state is the second time or less, then the controller returns to the step 202. If the current state is the third time, then the controller sets the optical sensors PxL, PxC and PxR in the emission flashing state and shifts to the flowchart of FIG. 22.

In the flowchart of FIG. 22, the controller first examines the paper money passage detection signal P2, shutter signal SHUT, optical sensor PxR and inlet sensor signal PIRL (steps 210, 211, 212 and 213). When any of the paper money passage detection signal P2, shutter signal SHUT, optical sensor PxR and inlet sensor signal PIRL has a level of "1", the controller judges the presence of an abnormality, sets the abnormality signal TRBL at "1", and returns to the step 210.

In the steps 210, 211, 212 and 213, if the paper money passage detection signal P2, shutter signal SHUT, optical sensor PxR and inlet sensor signal PIRL have all a level of "0", then the controller sets the abnormality signal TRBL at "0" and examines the power flag PF (step 214). When the power flag PF has a level of "0", the controller enters into the wait state. When determining in the step 214 that the power flag PF has a level of "1", the controller shifts to the flowchart of FIG. 18, sets the optical sensors PxL, PxC and PxR in the light emission state, sets the power flag PF at "0", and performs the operations of the step 111 and subsequent steps.

Figure 23:
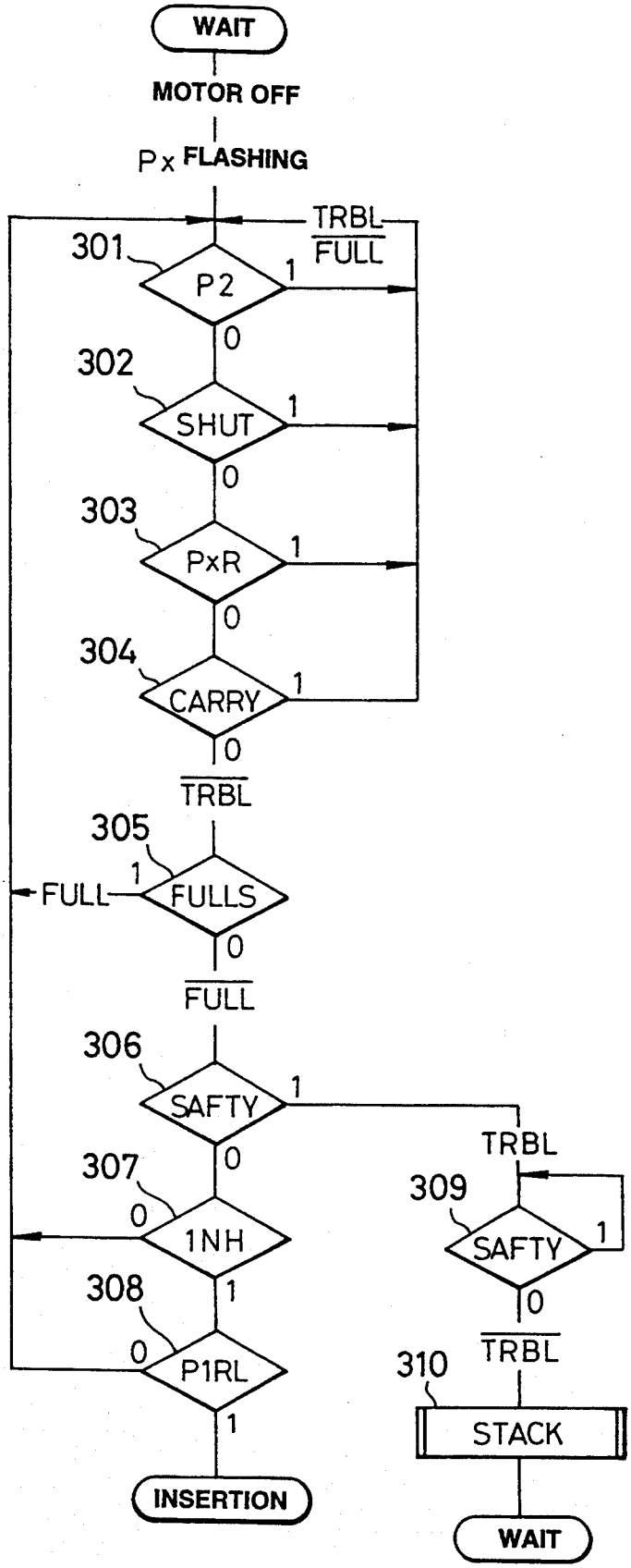
FIG. 23 is a flowchart showing the operation of the controller of FIG. 16 in its standby mode.

Wait state:

FIG. 23 shows the operation of the wait mode. In the wait mode, the controller monitors the paper money passage detection signal P2, shutter signal SHUT, the output of the optical sensor PxR, carrier signal CARRY, fully-stacked-money detection signal FULLS, safty signal SAFTY, acceptance inhibition signal INH and inlet sensor signal PIRL. When the paper money passage detection signal P2, shutter signal SHUT, the output of the optical sensor PxR, carrier signal CARRY, fully-stacked-money detection signal FULLS and safty signal SAFTY have all a level of "0" and when the acceptance inhibition signal INH and inlet sensor signal PIRL have both a level of "1", the controller executes the operation of shifting to the inserting operation of accepting insertion of a paper money to be detailed later.

In FIG. 23, the controller first turns OFF the driving motor 50 and sets the optical sensors PxL, PxC and PxR in the emission flashing state. Next, the controller examines the paper money passage detection signal P2, shutter signal SHUT, optical sensor PxR and carrier signal CARRY (step 301, 302, 303 and 304). When any of the paper money passage detection signal P2, shutter signal SHUT, optical sensor PxR and carrier signal CARRY has a level of "1", the controller judges the presence of an abnormality, sets the abnormality signal TRBL at "1", sets the full signal FULL at "0", and returns to the step 301.

When determining in the steps 301, 302, 303 and 304 that all of the paper money passage detection signal P2, shutter signal SHUT, optical sensor PxR and carrier signal CARRY have a level of "0", the controller sets the abnormality signal TRBL at "0" and then examines the fully-stacked-money detection signal FULLS (step 305). When the fully-stacked-money detection signal FULLS has a level of "1", the controller sets the full signal FULL at "1" and returns to the step 301.

When determining in the step 305 that the fully-stacked-money detection signal FULLS has a level of "0", the controller sets the full signal FULL at "0" and then examines the safty signal SAFTY (step 306). When the safty signal SAFTY has a level of "0", the controller then examines the acceptance inhibition signal INH (step 307). When the acceptance inhibition signal INH has a level of "0", the controller returns to the step 301; when the acceptance inhibition signal INH has a level of "1", the controller next examines the inlet sensor signal PIRL (step 308). When the inlet sensor signal PIRL has a level of "0", the controller returns to the step 301; while, when the inlet sensor signal PIRL has a level of "1", the controller shifts to the inserting operation.

When determining in the step 306 that the safty signal SAFTY has a level of "1", the controller judges the presence of an abnormality, sets the abnormality signal TRBL at "1", and again examines the safty signal SAFTY (step 309). When the safty signal SAFTY has a level of "1", the controller returns to the step 309; while when the safty signal SAFTY has a level of "0", the controller performs the stacking operation (step 310) and enters into the wait state.

Inserting operation:

FIGS. 24 to 36 show the paper money inserting operation. In the inserting operation, a paper money inserted through the paper money insert slot 3 is accepted. When the inserted paper money is judged as genuine, the controller generates a genuine bill signal BILL and guides the paper money to the stacking position. When the inserted paper money is not genuine, the controller shifts to the flowchart of FIG. 21 and executes the repayment operation.

Figure 24:
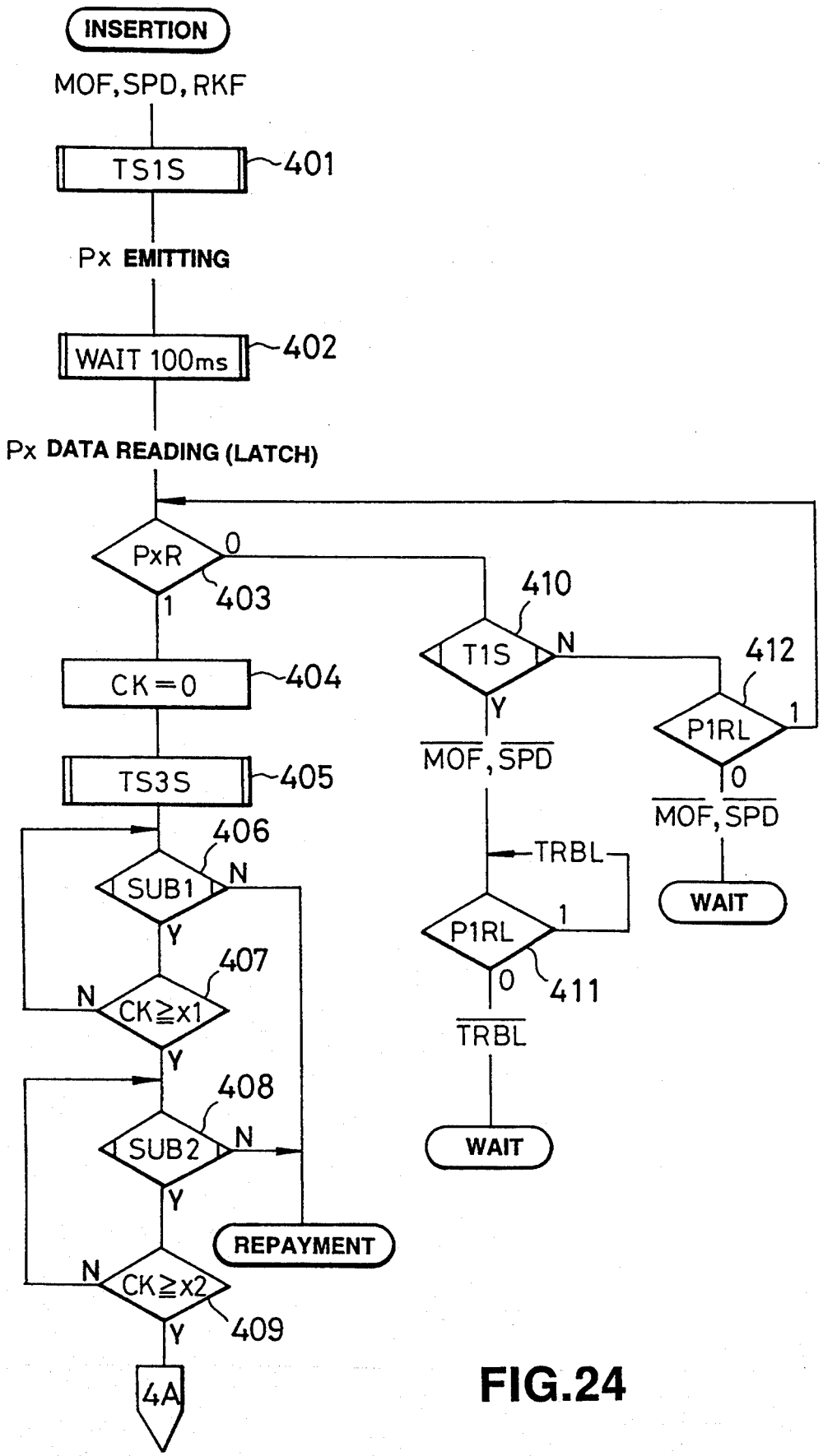
FIGS. 24 to 29 collectively show a flowchart showing the operation of the controller of FIG. 16 in its money insertion mode.
Figure 25:
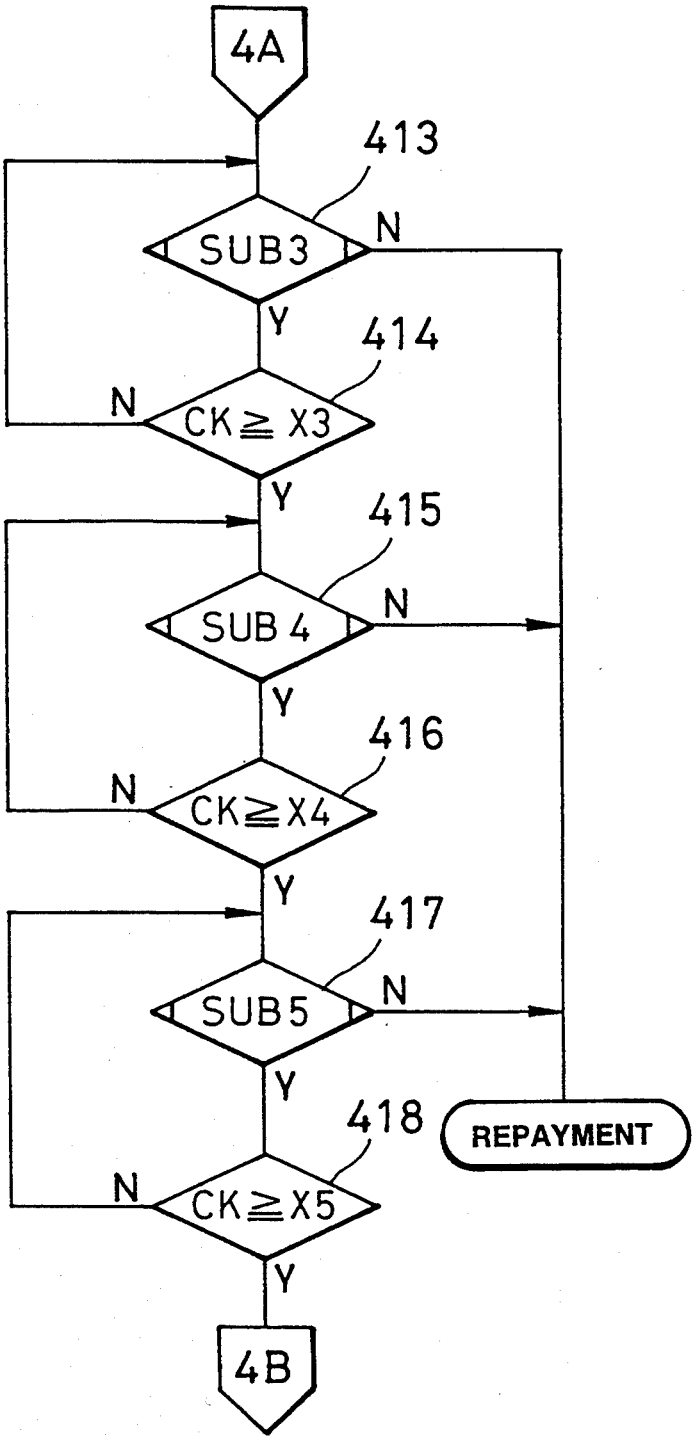
Figure 26:
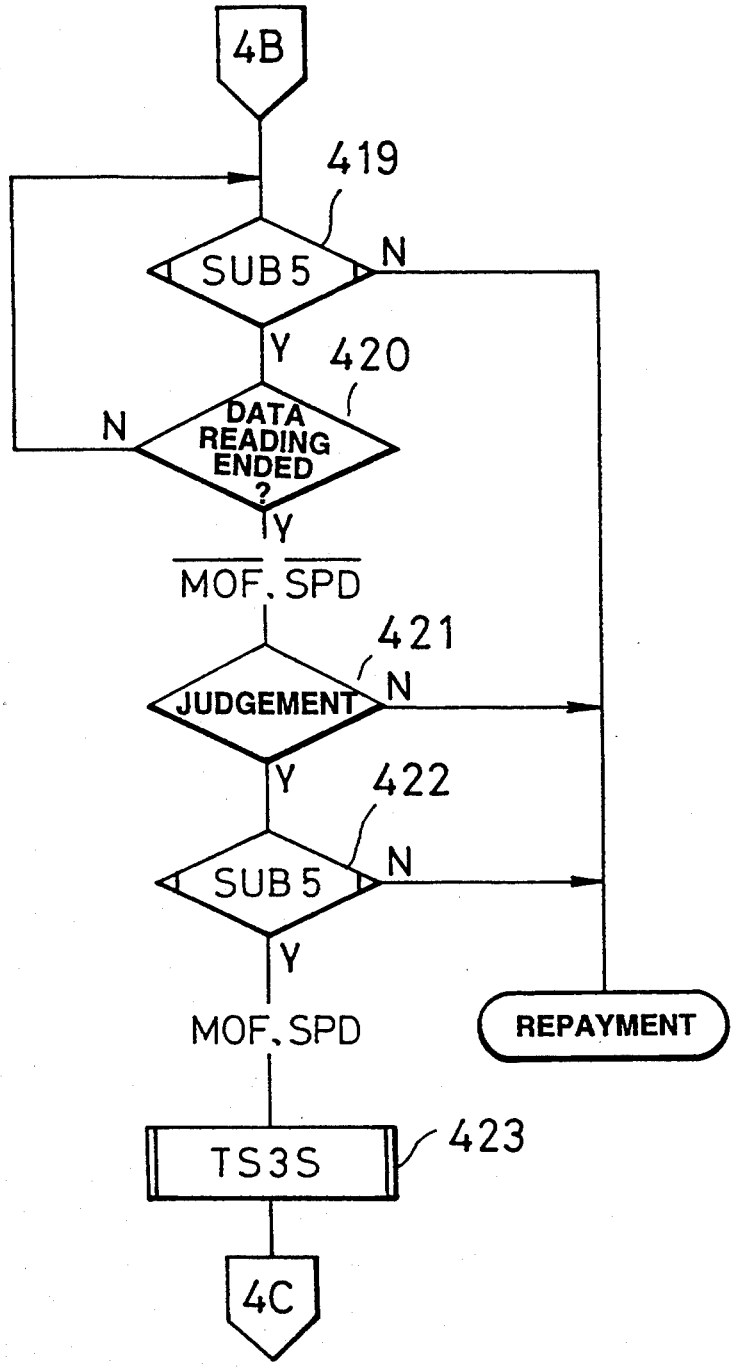

In FIG. 24, the controller first sets the motor forward drive signal MOF at "1", sets the constant-voltage control signal SPD at "1", sets a continuous insertion flag RKF at "1", and starts a 1 sec. timer (step 401). And the controller sets the optical sensors PxL, PxC and PxR in the light emission state, and waits for a time of 100 msec. (step 402). Subsequently, the controller performs the operation of reading data issued from the optical sensors PxL, PxC and PxR. The data reading operation will be detailed later.

Next, the controller examines the output of the optical sensor PxR (step 403). When the output of the optical sensor PxR has a level of "0", the controller examines whether or not the 1 sec. timer started in the step 401 expired (step 410). When the timer did not expire, the controller next examines the inlet sensor signal PIRL (step 412). When the inlet sensor signal PIRL has a level of "1", the controller returns to the step 403; while when the inlet sensor signal PIRL has a level of "0", the controller sets the motor forward drive signal MOF at "0", sets the constant-voltage control signal SPD at "0", and enters into the wait mode.

When determining in the step 410 that the 1 sec. timer started in the step 401 expired, the controller sets the motor forward drive signal MOF at "0", sets the constant-voltage control signal SPD at "0", and then examines the inlet sensor signal PIRL (step 411). When the inlet sensor signal PIRL has a level of "1", the controller judges the presence of an abnormality, sets the abnormality signal TRBL at "1" and returns to the step 411. When the inlet sensor signal PIRL has a level of "0", the controller sets the abnormality signal TRBL at "0" and enters into the wait mode.

When determining in the step 403 that the output of the optical sensor PxR has a level of "1", the controller clears the counted value CK of the motor pulse MOPLS to zero (step 404) and starts a 3 sec. timer (step 405). Subsequently, the controller executes the subroutine SUB1 (step 406).

Figure 30:
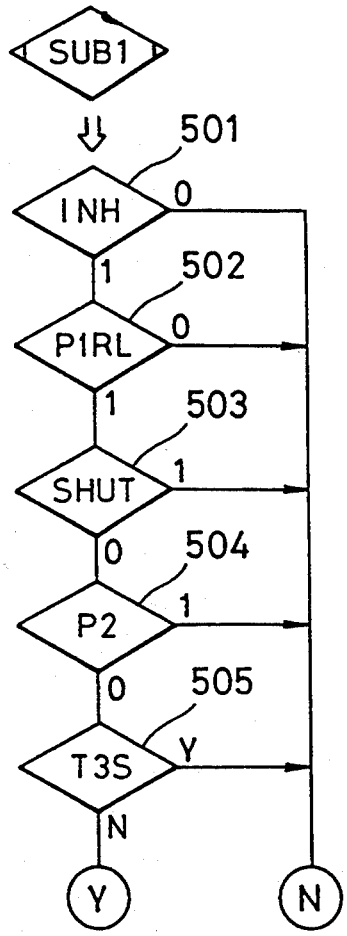
FIG. 30 is a flowchart showing details of a subroutine SUB1 shown in FIG. 24.

The details of the subroutine SUB1 is shown in FIG. 30. In the subroutine SUB1, the controller examines the acceptance inhibition signal INH, inlet sensor signal PIRL, shutter signal SHUT and paper money passage detection signal P2 (steps 501, 502, 503 and 504); and examines whether or not the 3 sec. timer started in the step 405 expired (step 505). If the acceptance inhibition signal INH and inlet sensor signal PIRL have both a level of "1", the shutter signal SHUT and paper money passage detection signal P2 have both a level of "0" and the 3 sec. timer started in the step 405 did not expire yet, then the controller judges "YES" and goes to a point marked by "Y" in the drawing). If either one of the acceptance inhibition signal INH and inlet sensor signal PIRL has a level of "0", or either one of the shutter signal SHUT and paper money passage detection signal P2 has a level of "1" or the 3 sec. timer started in the step 405 expired already, then the controller judges "NO" and goes to a point marked by "N" in the drawing).

When the controller judges "NO" through the subroutine SUB1, the controller shifts to the flowchart of FIG. 21 and performs the repayment operation.

Meanwhile, when judging "YES" through the subroutine SUB1, the controller judges whether or not the counted value CK of the motor pulse MOPLS is larger than the predetermined value x1, that is, whether or not the relationship $CK \geqq x1$ is satisfied (step 407). When determining that relationship $CK \geqq x1$ is not satisfied, the controller returns to the step 406; while when determining that relationship $CK \geqq x1$ is satisfied, the controller next executes the subroutine SUB2 (step 408).

Figure 31:
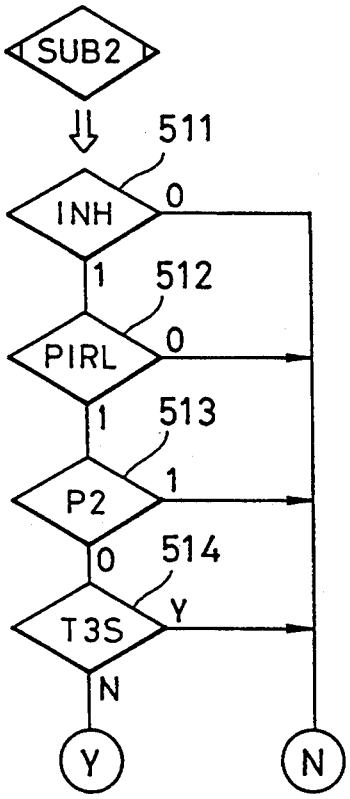
FIG. 31 is a flowchart showing details of a subroutine SUB2 shown in FIG. 24.

The details of the subroutine SUB2 is shown in FIG. 31. In the subroutine SUB2 of the drawing, the controller examines the acceptance inhibition signal INH, inlet sensor signal PIRL and paper money passage detection signal P2 (steps 511, 512 and 513) and then examines whether or not the 3 sec. timer started in the step 405 expired (step 514). If the acceptance inhibition signal INH and inlet sensor signal PIRL have both a level of "1", the paper money passage detection signal P2 has a level of "0", and the 3 sec. timer started in the step 405 did not expire yet, then the controller judges "YES" and goes to a point marked by "Y". If either one of the acceptance inhibition signal INH and inlet sensor signal PIRL has a level of "0", or the paper money passage detection signal P2 has a level of "1", or the 3 sec. timer started in the step 405 expired already, then the controller judges "NO" and goes to a point marked by "N".

When the controller judges "NO" through the subroutine SUB2, the controller shifts to the flowchart of FIG. 21 and performs the repayment operation.

Meanwhile, when judging "YES" through the subroutine SUB2, the controller judges whether or not the counted value CK of the motor pulse MOPLS is larger than the predetermined value x2, that is, whether or not the relationship $CK \geqq x2$ is satisfied (step 409). When determining that relationship $CK \geqq x2$ is not satisfied, the controller returns to the step 408; while when determining that relationship $CK \geqq x2$ is satisfied, the controller shifts to the flowchart of FIG. 25 and executes the subroutine SUB3 (step 413).

Figure 32:
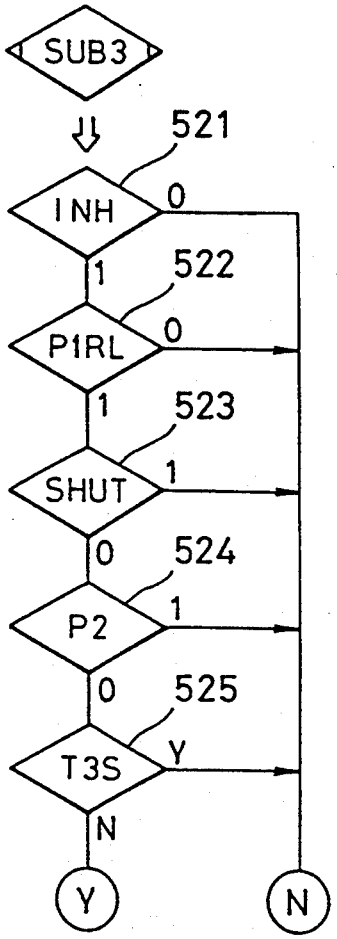
FIG. 32 is a flowchart showing details of a subroutine SUB3 shown in FIG. 25.

The details of the subroutine SUB3 is shown in FIG. 32. In the subroutine SUB3 of the drawing, the controller examines the acceptance inhibition signal INH, inlet sensor signal PIRL, shutter signal SHUT and paper money passage detection signal P2 ( steps 521, 522, 523 and 524) and then examines whether or not the 3 sec. timer started in the step 405 expired (step 525). If the acceptance inhibition signal INH, inlet sensor signal PIRL and shutter signal SHUT have all a level of "1", the paper money passage detection signal P2 has a level of "0", and the 3 sec. timer started in the step 405 did not expire yet, then the controller judges "YES" and goes to a point marked by "Y". If either one of the acceptance inhibition signal INH, inlet sensor signal PIRL and shutter signal SHUT has a level of "0", or the paper money passage detection signal P2 has a level of "1", or the 3 sec. timer started in the step 405 expired already, then the controller judges "NO" and goes to a point marked by "N".

When the controller judges "NO" through the subroutine SUB3, the controller shifts to the flowchart of FIG. 21 and performs the repayment operation.

Meanwhile, when judging "YES" through the subroutine SUB3, the controller judges whether or not the counted value CK of the motor pulse MOPLS is larger than the predetermined value x3, that is, whether or not the relationship CK≧x3 is satisfied. When determining that relationship CK≧x3 is not satisfied, the controller returns to the step 413; while when determining that relationship CK≧x3 is satisfied, the controller executes the subroutine SUB4 (step 415).

Figure 33:
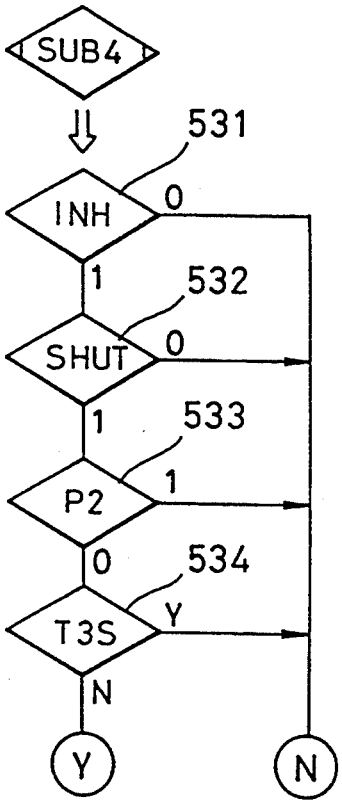
FIG. 33 is a flowchart showing details of a subroutine SUB4 shown in FIG. 25.

The details of the subroutine SUB4 is shown in FIG. 33. In the subroutine SUB4 of the drawing, the controller examines the acceptance inhibition signal INH, shutter signal SHUT and paper money passage detection signal P2 (steps 531, 532, and 533) and then examines whether or not the 3 sec. timer started in the step 405 expired (step 534). If the acceptance inhibition signal INH and shutter signal SHUT have both a level of "1", the paper money passage detection signal P2 has a level of "0", and the 3 sec. timer started in the step 405 did not expire yet, then the controller judges "YES" and goes to a point marked by "Y". If either one of the acceptance inhibition signal INH and shutter signal SHUT has a level of "0", or the paper money passage detection signal P2 has a level of "1" or the 3 sec timer started in the step 405 expired already, then the controller judges "NO" and goes to a point marked by "N".

When the controller judges "NO" through the subroutine SUB4, the controller shifts to the flowchart of FIG. 21 and performs the repayment operation.

Meanwhile, when judging "YES" through the subroutine SUB4, the controller judges whether or not the counted value CK of the motor pulse MOPLS is larger than a predetermined value x4, that is, whether or not the relationship CK≧x4 is satisfied. When determining that relationship CK≧x4 is not satisfied, the controller returns to the step 415; while when determining that relationship CK≧x4 is satisfied, the controller executes the subroutine SUB5 (step 417).

Figure 34:
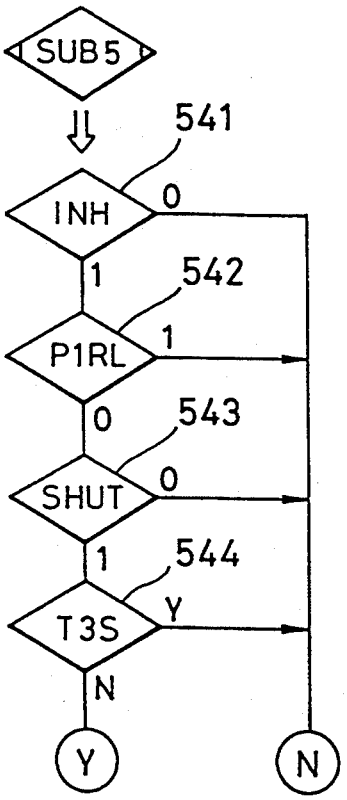
FIG. 34 is a flowchart showing details of a subroutine SUB5 shown in FIGS. 25 and 26.

The details of the subroutine SUB5 is shown in FIG. 34. In the subroutine SUB5 of the drawing, the controller examines the acceptance inhibition signal INH, inlet sensor signal PIRL and shutter signal SHUT (steps 541, 542 and 543) and then examines whether or not the 3 sec. timer started in the step 405 expired (step 544). If the acceptance inhibition signal INH has a level of "1" the inlet sensor signal PIRL has a level of "0" the shutter signal SHUT has a level of "1", and the 3 sec. timer started in the step 405 did not expire yet, then the controller judges "YES" and goes to a point marked by "Y". If the acceptance inhibition signal INH has a level of "0", or the inlet sensor signal PIRL has a level of "1" or the shutter signal SHUT has a level of "0", or the 3 sec. timer started in the step 405 expired already, then the controller judges "NO" and goes to a point marked by "N".

When the controller judges "NO" through the subroutine SUB5, the controller shifts to the flowchart of FIG. 21 and performs the repayment operation.

Meanwhile, when judging "YES" through the subroutine SUB5, the controller judges whether or not the counted value CK of the motor pulse MOPLS is larger than a predetermined value x5, that is, whether or not the relationship CK≧x5 is satisfied. When determining that relationship CK≧x5 is not satisfied, the controller returns to the step 417; while when determining that relationship CK≧x5 is satisfied, the controller shifts to the flowchart of FIG. 26 and again executes the subroutine SUB5 (step 419).

When the controller judges "NO" through the subroutine SUB 5, the controller performs the repayment operation.

When the controller judges "YES" through the subroutine SUBS, the controller next judges whether or not the data reading operation or data reading processing was terminated (step 420). When the data reading operation is not terminated yet, the controller returns to the step 419; while when the data reading operation was terminated, the controller sets the motor forward drive signal MOF at "0", sets the constant-voltage control signal SPD at "0", and judges whether or not the fed paper money is genuine (step 421). When determining that the paper money is not genuine ("NO" in the step 421), the controller shifts to the flowchart of FIG. 21 and performs the repayment operation.

When determining in the step 421 that the paper money is true ("YES" in the step 421), the controller again executes the subroutine SUB5 (step 422).

When the controller judges "NO" through the subroutine SUB5, the controller shifts to the flowchart of FIG. 21 and performs the repayment operation.

Figure 27:
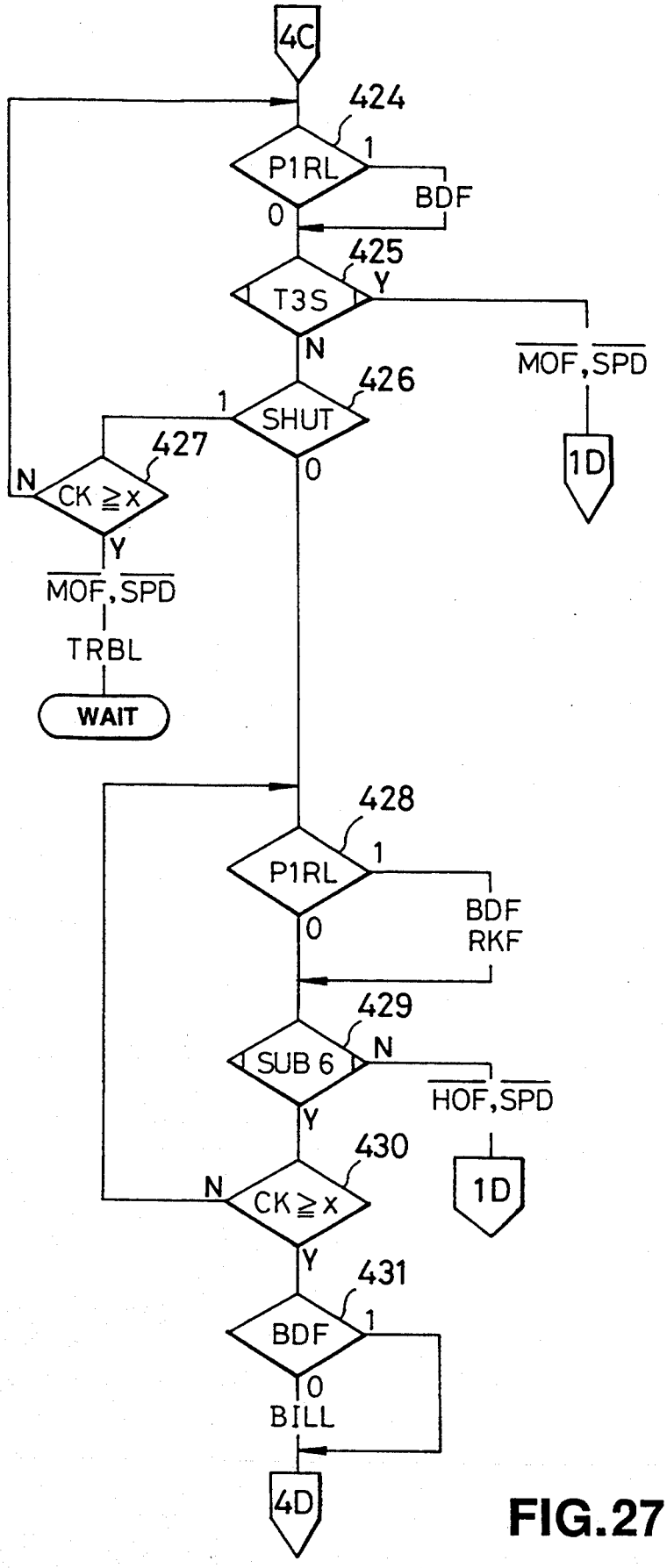
Figure 28:
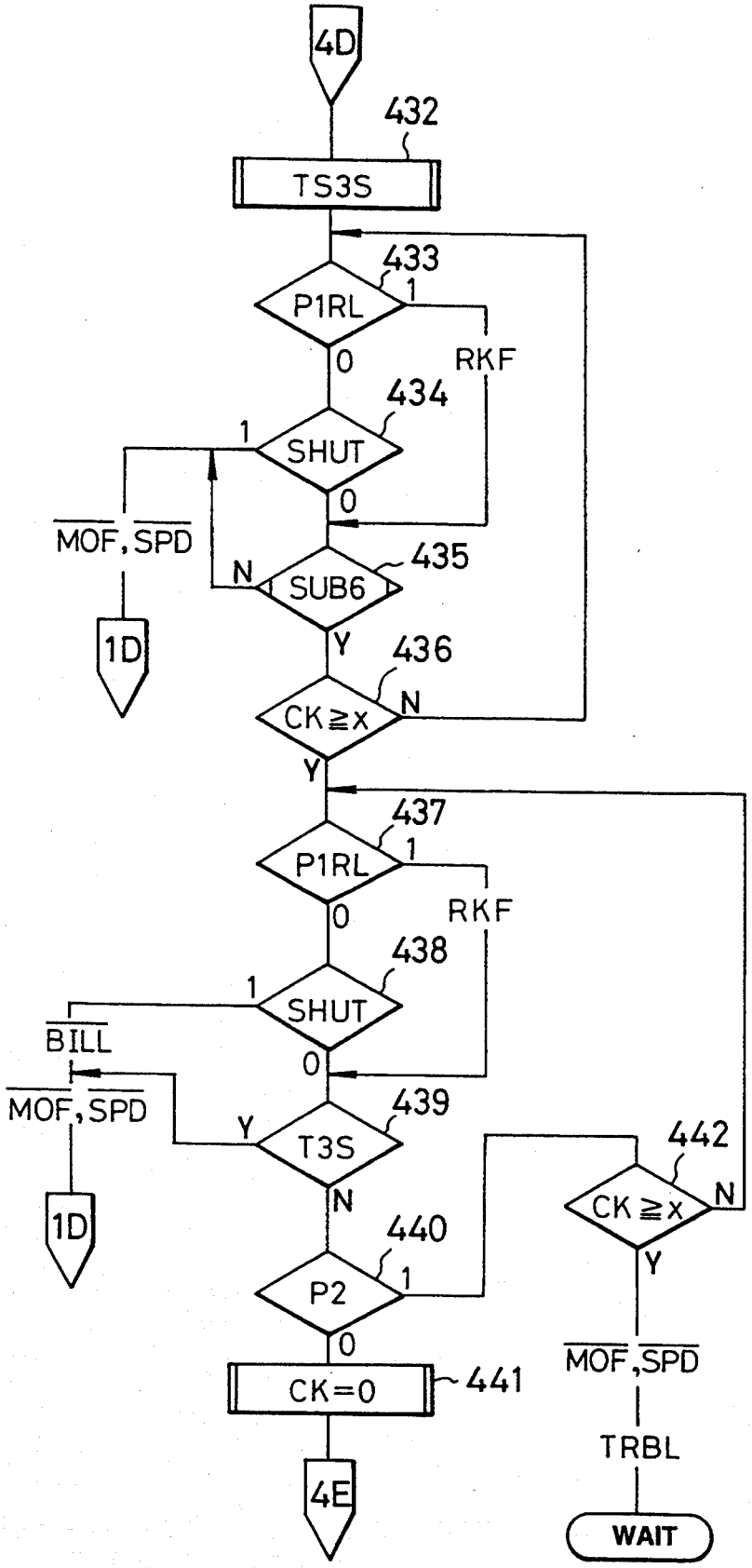

When the controller judges "YES" through the subroutine SUB5, the controller sets the motor forward drive signal MOF at "1", sets the constant-voltage control signal SPD at "1", starts the 3 sec. timer (step 423), shifts to the flowchart of FIG. 27, and examines the inlet sensor signal PIRL (step 424). If the inlet sensor signal PIRL has a level of "1", then the controller sets a genuine bill delay flag BDF at "1". If the inlet sensor signal PIRL has a level of "0", then the controller shifts directly to the step 425 without any execution and examines whether or not the 3 sec. timer started in the step 423 expired. When determining that the 3 sec. timer expired, the controller sets the motor forward drive signal MOF at "0", sets the constant-voltage control signal SPD at "0", shifts to the flowchart of FIG. 18, and sets the abnormality signal TRBL indicative of an abnormality at "1".

when determining in the step 425 that the 3 sec. timer started in the step 423 did not expire yet, the controller next examines the shutter signal SHUT (step 426). When the shutter signal SHUT has a level of "1", the controller examines whether or not the counted value CK of the motor pulse MOPLS is larger than the predetermined value x, that is, whether or not the relationship CK≧x is satisfied (step 427). When the relationship CK≧x is not satisfied, the controller returns to the step 424. When the relationship CK≧x is satisfied, the controller sets the motor forward drive signal MOF at "0", sets the constant-voltage control signal SPD at "0", sets the abnormality signal TRBL indicative of an abnormality at "1", and enters into the wait state.

When determining in the step 426 that the shutter signal SHUT has a level of "0", the controller next examines the inlet sensor signal PIRL (step 428). When the inlet sensor signal PIRL has a level of "1", the controller sets the Genuine bill delay flag BDF at "1", sets the continuous insertion flag RKF at "1". When the inlet sensor signal PIRL has a level of "0", the controller shifts to the step 429 and performs the subroutine SUB6.

Figure 35:
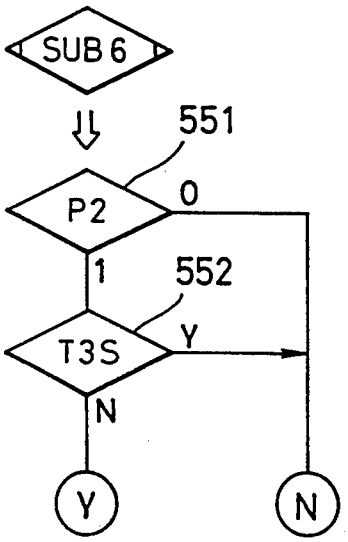
FIG. 35 is a flowchart showing details of a subroutine SUB6 shown in FIGS. 26 and 27.

The details of the subroutine SUB6 is shown in FIG. 35. In the subroutine SUB6 of the drawing, the controller examines the paper money passage detection signal P2 (step 551) and then examines whether or not the 3 sec. timer started in the step 423 expired (step 552). If the paper money passage detection signal P2 has a level of "1" and the 3 sec timer started in the step 423 did not expire yet, then the controller judges "YES" and goes to a point marked by "Y". If the paper money passage detection signal P2 has a level of "0", or the 3 sec. timer started in the step 423 expired already, then the controller judges "NO" and goes to a point marked by "N".

When the controller judges "NO" through the subroutine SUB6, the controller sets the motor forward drive signal MOF at "0", sets the constant-voltage control signal SPD at "0", shifts to the flowchart of FIG. 18 and sets the abnormality signal TRBL indicative of an abnormality at "1".

Meanwhile, when judging "YES" through the subroutine SUB6, the controller judges whether or not the counted value CK of the motor pulse MOPLS is larger than a predetermined value x, that is, whether or not the relationship CK≧x is satisfied (step 430). When determining that relationship CK≧x is not satisfied, the controller returns to the step 428; while when determining that relationship CK≧x is satisfied, the controller examines the genuine bill delay flag BDF (step 431). When the genuine bill delay flag BDF has a level of "1", the controller keeps the current state. When the genuine bill delay flag BDF has a level of "0", the controller sets the genuine bill signal BILL at "1", shifts to the flowchart of FIG. 28, and starts the 3 sec. timer (step 432).

The controller next examines the inlet sensor signal PIRL (step 433). When the inlet sensor signal PIRL has a level of "0", the controller next examines the shutter signal SHUT (step 434). When the shutter signal SHUT has a level of "1", the controller sets the motor forward drive signal MOF at "0", sets the constant-voltage control signal SPD at "0", shifts to the flowchart of FIG. 18, and sets the abnormality signal TRBL indicative of an abnormality at "1".

When determining in the step 433 that the inlet sensor signal PIRL has a level of "1", the controller sets the continuous insertion flag RKF at "1". When determining in the step 434 that shutter signal SHUT has a level of "0", the controller shifts to the step 435, and again executes the subroutine SUB6.

When the controller judges "NO" through the subroutine SUB6, the controller sets the motor forward drive signal MOF at "0", sets the constant-voltage control signal SPD at "0", shifts to the flowchart of FIG. 18. and sets the abnormality signal TRBL indicative of an abnormality at "1".

When the controller judges "YES" through the subroutine SUB6, the controller examines whether or not the counted value CK of the motor pulse MOPLS is larger than the predetermined value x, that is, whether or not the relationship CK≧x is satisfied (step 436). When the relationship CK≧x is not satisfied, the controller returns to the step 433. When the relationship CK≧x is satisfied, the controller next examines the inlet sensor signal PIRL (step 437). When the inlet sensor signal PIRL has a level of "0", the controller next examines the shutter signal SHUT (step 438). When the shutter signal SHUT has a level of "1", the controller sets the genuine bill signal BILL at "0", sets the motor forward drive signal MOF at "0", sets the constant-voltage control signal SPD at "0", shifts to the flowchart of FIG. 18, and sets the abnormality signal TRBL indicative of an abnormality at "1".

When determining in the step 437 that the inlet sensor signal PIRL has a level of "1" the controller sets the continuous insertion flag RKF at "1". When the shutter signal SHUT has a level of "0" in the step 438, the controller shifts directly to the step 439 without any execution and examines whether or not the timer started in the step 432 expired (step 439). When determining that the timer started in the step 432 expired, the controller sets the motor forward drive signal MOF at "0", sets the constant-voltage control signal SPD at "0", shifts to the flowchart of FIG. 18, and sets the abnormality signal TRBL indicative of an abnormality at "1".

When determining in the step 439 that the timer started in the step 432 did not expire yet, the controller next examines the paper money passage detection signal P2 (step 440). When the paper money passage detection signal P2 has a level of "1", the controller next examines whether or not the counted value CK of the motor pulse MOPLS is larger than the predetermined value x, that is, whether or not the relationship CK≧x is satisfied (step 442). When the relationship CK≧x is not satisfied, the controller returns to the step 437. When the relationship CK≧x is satisfied, the controller next sets the motor forward drive signal MOF at "0", sets the constant-voltage control signal SPD at "0", sets the abnormality signal TRBL indicative of an abnormality at "1", and enters into the wait mode.

Figure 29:
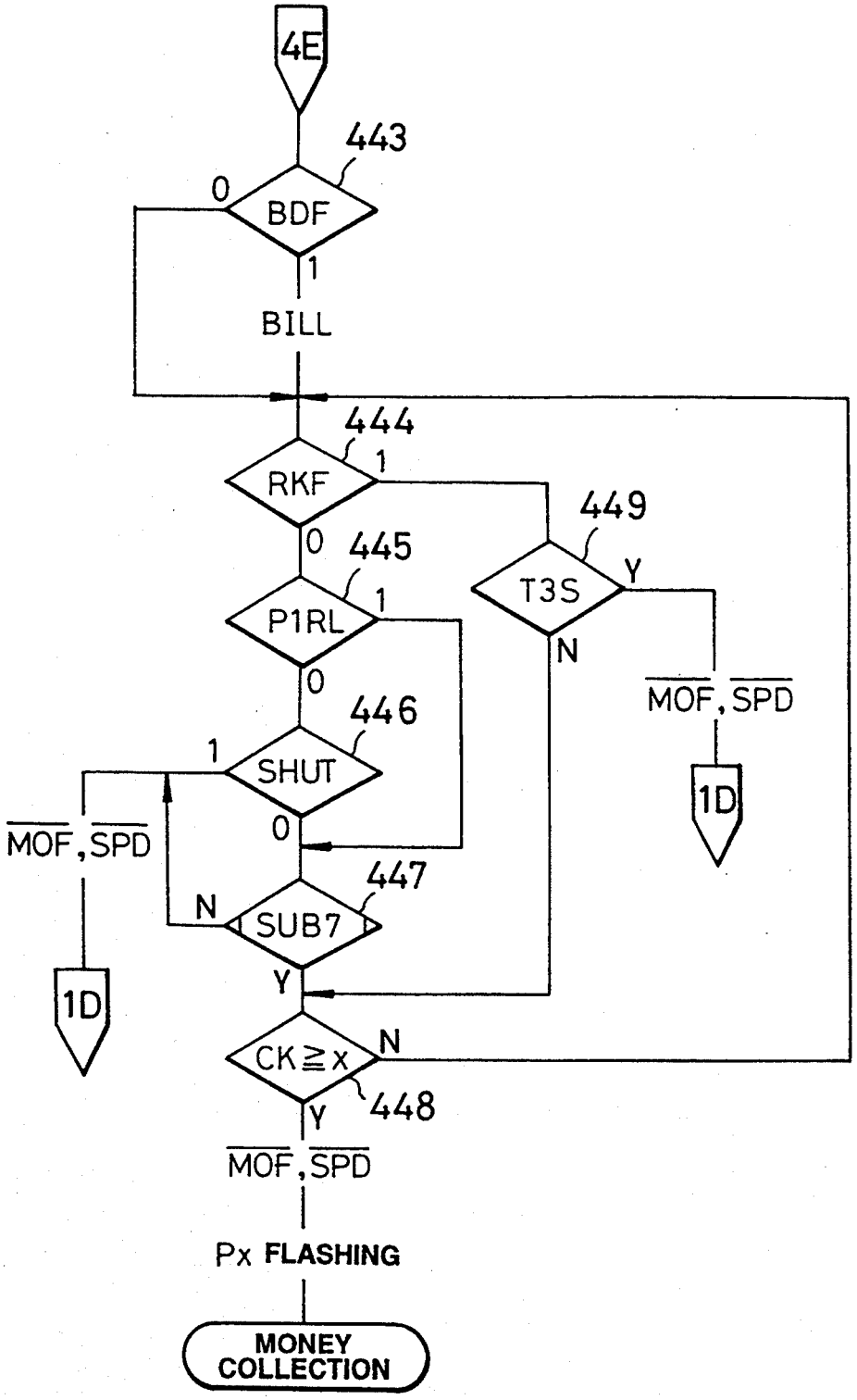

When determining in the step 440 that the paper money passage detection signal P2 has a level of "0", the controller clears the counted value CK of the motor pulse MOPLS to zero (step 441), shifts to the flowchart of FIG. 29, and then examines the genuine bill delay flag BDF (step 443). When the genuine bill delay flag BDF has a level of "1", the controller sets the genuine bill signal BILL at "1". When the genuine bill delay flag BDF has a level of "0", the controller shifts directly to the step 444 and examines the continuous insertion flag RKF. When the continuous insertion flag RKF has a level of "0", the controller examines the inlet sensor signal PIRL (step 445). When the inlet sensor signal PIRL has a level of "0", the controller next examines the shutter signal SHUT (step 446). When the shutter signal SHUT has a level of "1", the controller sets the motor forward drive signal MOF at "0", sets the constant-voltage control signal SPD at "0", shift to the flowchart of FIG. 18, and sets the abnormality signal TRBL indicative of an abnormality at "1".

When determining in the step 445 that the inlet sensor signal PIRL has a level of "1" or when determining in the step 446 that shutter signal SHUT has a level of "0", the controller executes the subroutine SUB7 (step 447).

Figure 36:
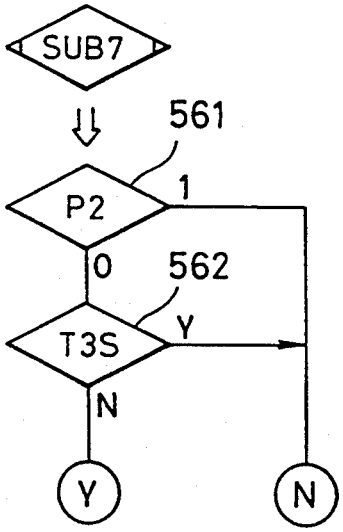
FIG. 36 is a flowchart showing details of a subroutine SUB7 shown in FIG. 29.

The details of the subroutine SUB7 is shown in FIG. 36. In the subroutine SUB7 of the drawing, the controller examines the paper money passage detection signal. P2 (step 561) and then examines whether or not the 3 sec. timer started in the step 432 expired (step 562). If the paper money passage detection signal P2 has a level of "0", and the 3 sec. timer started in the step 423 did not expire yet, then the controller judges "YES" and goes to a point marked by "Y". If the paper money passage detection signal P2 has a level of "1", or the 3 sec. timer started in the step 405 expired already, then the controller judges "NO" and goes to a point marked by "N ".

When the controller judges "NO" through the subroutine SUB7, the controller sets the motor forward drive signal MOF at "0", sets the constant-voltage control signal SPD at "0", shifts to the flowchart of FIG. 18, and sets the abnormality signal TRBL indicative of an abnormality at "1".

When judging "YES" through the subroutine SUB7, the controller next examines whether or not the counted value CK of the motor pulse MOPLS is larger than the predetermined value x, that is, whether or not the relationship CK≧x is satisfied (step 448). When the relationship CK≧x is not satisfied, the controller returns to the step 444. When the relationship CK≧x is satisfied, the controller next sets the motor forward drive signal MOF at "0", sets the constant-voltage control signal SPD at "0", sets the optical sensors PxL, PxC and PxR in the emission flashing state, and shifts to the money collecting operation to be described later.

When determining in the step 444 that the continuous insertion flag RKF has a level of "1", the controller next examines whether or not the 3 sec. timer started in the step 432 expired (step 449). When the timer did not expire yet, the controller shifts to the step 448; while when the timer expired, the controller sets the motor forward drive signal MOF at "0", sets the constant-voltage control signal SPD at "0", shifts to the flowchart of FIG. 18, and sets the abnormality signal TRBL indicative of an abnormality at "1".

FIG. 37 is a table showing the operations of the aforementioned subroutines SUB1 to SUB7. As will be clear from FIG. 37, such a state is detected in the subroutine SUB1 that only the inlet sensor signal PIRL has a level of "1", i.e., that only the rotation of the lever 81 caused by the paper money inserted through the paper money insert slot 3 is detected by the inlet sensor 80; such a state is detected in the subroutine SUB2 that the inlet sensor signal PIRL has a level of "1", the shutter signal SHUT is indefinite and the paper money passage detection signal P2 has a level of "0", i.e., that the rotation of the lever 81 is detected by the inlet sensor 80, the rotation of pull-out prevention lever 82 is detected by the shutter switch 84 but the rotation of the paper money passage lever 83 is not detected by the paper money passage detection switch 85; such a state is detected in the subroutine SUB3 that the inlet sensor signal PIRL has a level of "1", the shutter signal SHUT has a level of "1" and the paper money passage detection signal P2 has a level of "0", i.e., that the rotation of the lever 81 is detected by the inlet sensor 80, the rotation of pull-out prevention lever 82 is detected by the shutter switch 84, and the rotation of the paper money passage lever 83 is not detected by the paper money passage detection switch 85; such a state is detected in the subroutine SUB4 that the inlet sensor signal PIRL is indefinite, the shutter signal SHUT has a level of "1" and the paper money passage detection signal P2 has a level of "0", i.e., that the rotation of pull-out prevention lever 82 is detected by the shutter switch 84, the lever 81 detected by the inlet sensor 80 is returned to the original position, and the rotation of the paper money passage lever 83 is not detected by the paper money passage detection switch 85; such a state is detected in the subroutine SUB5 that the inlet sensor signal PIRL has a level of "0", the shutter signal SHUT has a level of "1" and the paper money passage detection signal P2 is indefinite, i.e., that the lever 81 detected by the inlet sensor 80 is returned to the original position, the rotation of pull-out prevention lever 82 is detected by the shutter switch 84, and the rotation of the paper money passage lever 83 is detected by the paper money passage detection switch 85; such a state is detected in the subroutine SUB6 that the inlet sensor signal PIRL and the shutter signal SHUT are indefinite and the paper money passage detection signal P2 has a level of "1", i.e., that the rotation of the paper money passage lever 83 is detected by the paper money passage detection switch 85 regardless of the outputs of the inlet sensor 80 and shutter switch 84; and such a state is detected in the subroutine SUB7 that the inlet sensor signal PIRL and the shutter signal SHUT are indefinite and the paper money passage detection signal P2 has a level of "0", i.e., that the paper money passage lever 83 is returned to the original position regardless of the outputs of the inlet sensor 80 and shutter switch 84. FIG. 8 corresponds to the state detected through the subroutine SUB2 or SUB3, FIG. 9 corresponds to the state detected through the subroutine SUB5 or SUB6, FIG. 10 corresponds to the state detected through the subroutine SUB 6 and FIG. 11 corresponds to the state detected through the subroutine SUB7. In the states of the subroutines SUB 1 to SUB5, i.e., during the time after rotation of the pull-out prevention lever 82 before return of the lever to the original position or in other words, in the money returnable state; the controller examines the acceptance inhibition signal INH. When the acceptance inhibition signal INH has a level of "0" or in other words, in the acceptance inhibiting state; the controller immediately shifts to the repayment operation. However, in the state of the subroutines SUB 6 and SUB 7, i.e., when the pull-out prevention lever 82 may possibly be returned to the original position or in other words, in a money unreturnable state; the controller does to judge the acceptance inhibition signal INH.

In the present embodiment, the controller 100 shown in FIG. 16 receives the data of a paper money inserted through the paper money insert slot 3 in synchronism with the motor pulse MOPLS issued from the encoder 70 in the form of the outputs of the three optical sensors PxL, PxC and PxR and the outputs of the two magnetic sensors LHD and RHD in FIG. 7, and judges whether or not the inserted bill is genuine on the basis of the received data from time to time. As soon as determining that the inserted bill is not genuine, the controller shifts directly to the repayment operation shown by the flowchart of FIG. 21, and reversely drives the motor 50 to return the false-judged bill (judgement-on-demand operation).

More in detail, when the paper money inserted through the paper money insert slot 3 is detected by the output of the optical sensor PxR, the controller starts counting of the motor pulse MOPLS issued from the encoder 70, and starts its sampling operation of the read-out data of the three optical sensors PxL, PxC and PxR and two magnetic sensors LHD and RHD in synchronism with the motor pulse MOPLS.

That is, when the motor pulse MOPLS is output from the encoder 70, the motor pulse MOPLS is used as an interrupt signal in the controller 100. The controller 100 performs, on the basis of the interrupt signal, its data receiving operation of the optical data in the order of 1) to 5) which follow. 1) Optical data read out by the optical sensor PxR (infrared ray).

2) Optical data read out by the optical sensor PxC (red ray).
3) Optical data read out by the optical sensor PxL (infrared ray).
4) Magnetic data read out by the magnetic sensor RHD.

5) Magnetic data read out by the magnetic sensor LHD.

And the controller finds an average of 5 data corresponding to 5 pulses in the respective optical data read out by the optical sensor PxR (infrared ray), by the optical sensor PxC (red ray) and by the optical sensor PxL (infrared ray); finds a ratio of the 3 data with the first-read data at the time of starting the data sampling being as "255"; and stores the data indicative of the ratio in the memory RAM (not shown) of the controller 100. More specifically, the controller sets the first-read data at the time of starting the data sampling of the three optical sensors PxL, PxC and PxR to be reference data DL0, DC0 and DR0 respectively, sets its average input data to be DLi, DCi and DRi respectively, and finds data MDLi, MDCi and MDRi to be stored in accordance with the following equations.

$$MDLi=(DLi+255)/DL0$$

$$MDCi=(DCi+255)/DC0$$

$$MDRi=(DRi+255)/DR0$$

When the input data DLi, DCi and DRi exceed the reference data DL0, DC0 and DR0, the controller stores "FFH" as the data MDLi, DMCi and MDRi to be stored.

According to the above storage method, even when the respective input data are subjected to 10 bits of analog-to-digital conversion and then input to the controller, the respective storage data MDL, MDCi and MDRi can be suppressed to 1 bit or less.

Further, the magnetic data read out by the magnetic sensor RHD and the magnetic data read out by the magnetic sensor LHD are also subjected to an averaging operation of 5 data corresponding 5 pulses in the respective magnetic data to obtain average data MRHDi and MLHDi that are then stored in the controller. When the average data MRHDi and MLHDi exceed 1 bite, the controller stores "FFH" in place of the average data MRHDi and MLHDi.

In this way, the 5 data MDLi, MDCi, MDRi, MRHDi and MLHDi calculated each time 5 motor pulses MOPLS are generated are stored in 5 identical addresses, and the inserted bill is subjected to the judgement-on-demand operation with respect to each address on the basis of the 5 data MDLi, MDCi, MDRi, MRHDi and MLHDi. In this conjunction, it is assumed in the present embodiment that the number of such addresses is set to be '40' to perform the judgement-on-demand operation with use of the 40 addresses. That is, in this case, with regard to one sheet of bill, 5×40 of data MDLi, MDCi, MDRi, MRHDi and MLHDi (i=1 to 40) are stored.

Further, in the 'ON' state in the column 'judgement-on-demand operation', the above-mentioned judgement-on-demand operation is carried out; while, in the 'OFF' state therein, the above judgement-on-demand operation is not carried out.

The aforementioned judgement-on-demand operation over the optical data is carried out as follows.

That is, three storage data MDLi, MDCi and MDRi for each address are added together to obtain an addition or total value, the total value is set to be 255, a ratio of the data for the respective sensors is found, and the ratio is compared with the previously stored values of the ROM table.

More in detail, the controller calculates a ratio A of the storage data MDRi corresponding to the sensor PxR in accordance with the equation, $A=(MDRi\times255)/(MDLi+MDCi+MDRi)$, and judges whether or not a calculated value A is within a range between upper and lower limits AH and AL of the value A previously stored in the ROM table, i.e., whether or not a relationship $AH\geqq A\geqq AL$ is satisfied. Next, the controller calculates a ratio B of an addition of the storage data MDRi corresponding to the sensor PxR and the storage data MDCi corresponding to the sensor PxC in accordance with the equation, $B=(MDRi+MDCi)\times255)/(MDLi+MDCi+MDRi)$, and judges whether or not a calculated value B is within a range between upper and lower limits BH and BL of the value B previously stored in the ROM table, i.e., whether or not a relationship $BH\geqq B\geqq BL$ is satisfied.

When the above two conditions are not satisfied, the controller judges that the inserted bill is not genuine.

The above judgement is carried out with respect to all four insertion directions, and when the above conditions are not satisfied in any one of the four directions, the controller judges that the inserted bill is not genuine.

In this way, the judgement-on-demand operation is carried out on the basis of the data stored at each address with regard to the inserted paper money so that, when determining that the inserted paper money is not genuine, the controller returns the inserted paper money, which results in that bill processing can be effected quickly.

In addition, since the density of the paper money in its lateral direction is judged based on the data stored at each address, such a false paper money that real bills are cut into bill parts and the bill parts are bonded onto another paper sheet can be easily distinguished.

When the controller completes writing operation of the data of the inserted paper money at all addresses in this way, the controller judges on the basis of the data written at the all addresses whether or not the inserted paper money is genuine. This judgement is carried out on the basis of, in the present embodiment, only the optical data MDLi, MDCi and MDRi. In this connection, such judgement may be carried out on the basis of the magnetic data MRHDi and MLHDi.

The judgement, after the controller completes the data writing operation at the all addresses, is carried out as follows.

First, the controller 100 processes the optical data MDLi, MDCi and MDRi stored in the RAM of the controller. More specifically, this processing of the controller is to find a maximum value and a minimum value from the optical data MDLi, MDCi and MDRi, to set the found maximum value to be '255', and to find ratios of the optical data MDLi, MDCi and MDRi at each address with respect to 255 fixed (which ratios will be referred to merely as the 255-based ratio data, hereinafter).

The controller then judges the maximum and minimum data on the basis of the found 255-based ratio data. The judging operation of the maximum and minimum data is carried out as follows. That is, the controller judges whether or not the following relationships Upper limit≧Upper limit value≧Lower limit Upper limit ≧Lower limit value≧Lower limit are satisfied on the basis of the ROM table in which values for judgement of upper and lower limits of upper and lower limit values are previously stored.

When the above relationships are not satisfied, the controller performs the similar judging operation over another direction. When the above conditions are not satisfied with respect to all of the four directions, the controller immediately shifts to the flowchart of FIG. 21 to return the inserted paper money.

When the above conditions are satisfied with respect to either one of the four directions, the controller judges the optical data in the associated direction. The optical data judgement of the controller is carried out by judging whether or not the following relationship Upper limit≧Optical data≧Lower limit is satisfied with respect to each optical data with use of the ROM table having the upper and lower limits already stored therein as associated with the respective optical sensors PxL, PxC and PxR. More specifically, the controller performs comparing and judging operation over the data corresponding to 40 addresses with respect to the optical sensors PxL, PxC and PxR sequentially. When all the optical data are not within the judgement values, the controller repeats the maximum/minimum judging operation with respect to another direction. When determining that all the optical data are within the judgement values through the above repetitive operation, the controller next judges whether or not the direction based on the aforementioned judgement-on-demand operation fully coincides with the direction of the this-time judging operation. When finding a full coincidence therebetween, the controller judges that the inserted paper money is genuine. When failing to find a coincidence with respect to all the four directions , however, the controller judges that the inserted paper money is not genuine and shifts to the repayment operation of FIG. 21.

In the present embodiment, the above ROM table contains data corresponding to three modes of acceptance up mode, standard mode and accuracy up mode in such a manner that, when the power is turned ON, selection of the ROM table is carried out depending on the state of the accuracy change-over port.

Figure 38:
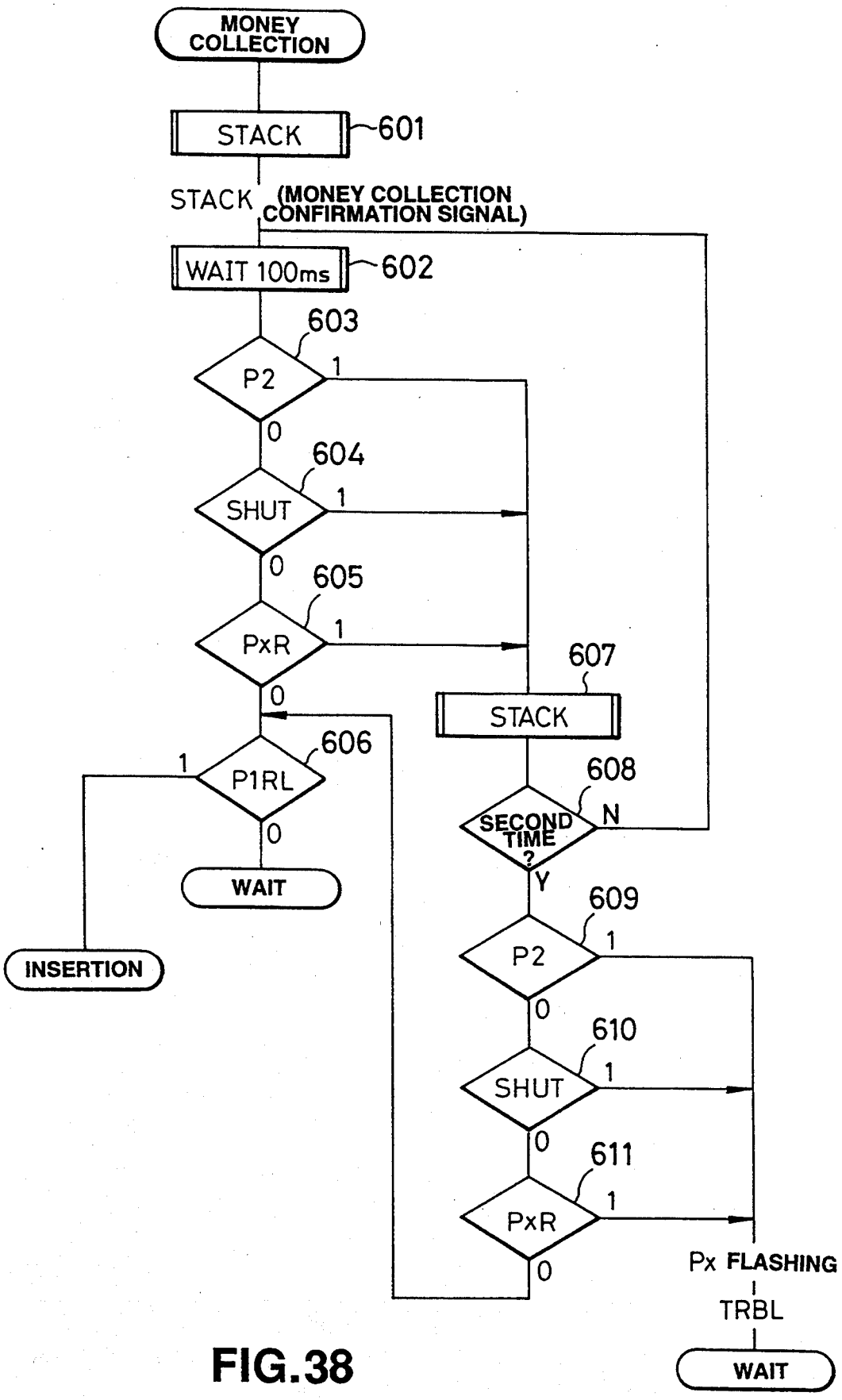
FIG. 38 is a flowchart showing the operation of the controller of FIG. 16 in its money collection mode.

Money collecting operation:

FIG. 38 shows the money collecting operation. In the money collecting operation, a fed paper money is pushed into the paper money accommodation box 6 for its accumulative accommodation and at the same time, a money collection confirmation signal STACK is generated.

In FIG. 38, more in detail, the controller first performs its stacking operation (step 601). The stacking operation will be detailed later. When completing the stacking operation, the controller sets the money collection confirmation signal STACK at "1" and waits for 100 msec. (step 602). Thereafter, the controller examines the paper money passage detection signal P2, the shutter signal SHUT and the output of the optical sensor PxR (steps 603, 604 and 605). When determining that the paper money passage detection signal P2, the shutter signal SHUT and the output of the optical sensor PxR have all a level of "0", the controller next examines the inlet sensor signal PIRL (STEP 606). When the inlet sensor signal PIRL has a level of "1", the controller shifts to the insertion operation, while the inlet sensor signal PIRL has a level of "0", the controller enters into the wait state.

When determining in the steps 603, 604 and 605 that any of the paper money passage detection signal P2, the shutter signal SHUT and the output of the optical sensor PxR has a level of "1", the controller again performs the stacking operation (step 607). When the stacking operation is not the second time, the controller returns to the step 602; while, when the stacking operation is the second time, the controller examines the paper money passage detection signal P2, the shutter signal SHUT and the output of the optical sensor PxR (steps 609, 610 and 611). At this time, when the paper money passage detection signal P2, the shutter signal SHUT and the output of the optical sensor PxR have all a level of "0", the controller shifts to the step 606.

When determining in the steps 609, 610 and 611 that any of the paper money passage detection signal P2, the shutter signal SHUT and the output of the optical sensor PxR has a level of "1" the controller sets the optical sensors PxL, PxC and PxR in the emission flashing state, sets the abnormality signal TRBL at "1", and enters into the wait mode.

Figure 39:
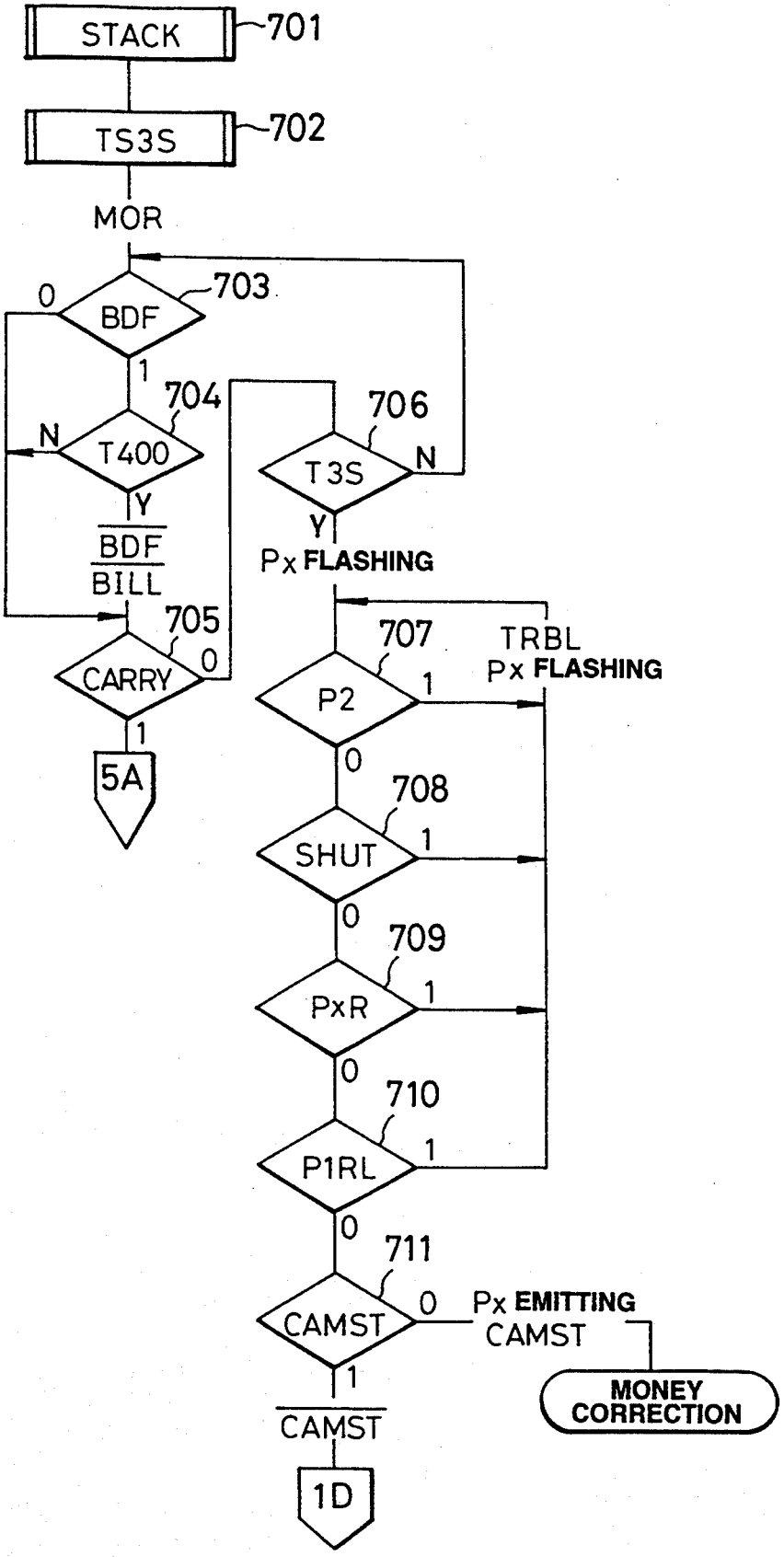
FIG. 39 to 41 collectively show a flowchart showing the operation of the controller of FIG. 16 in its stacking operation.
Figure 40:
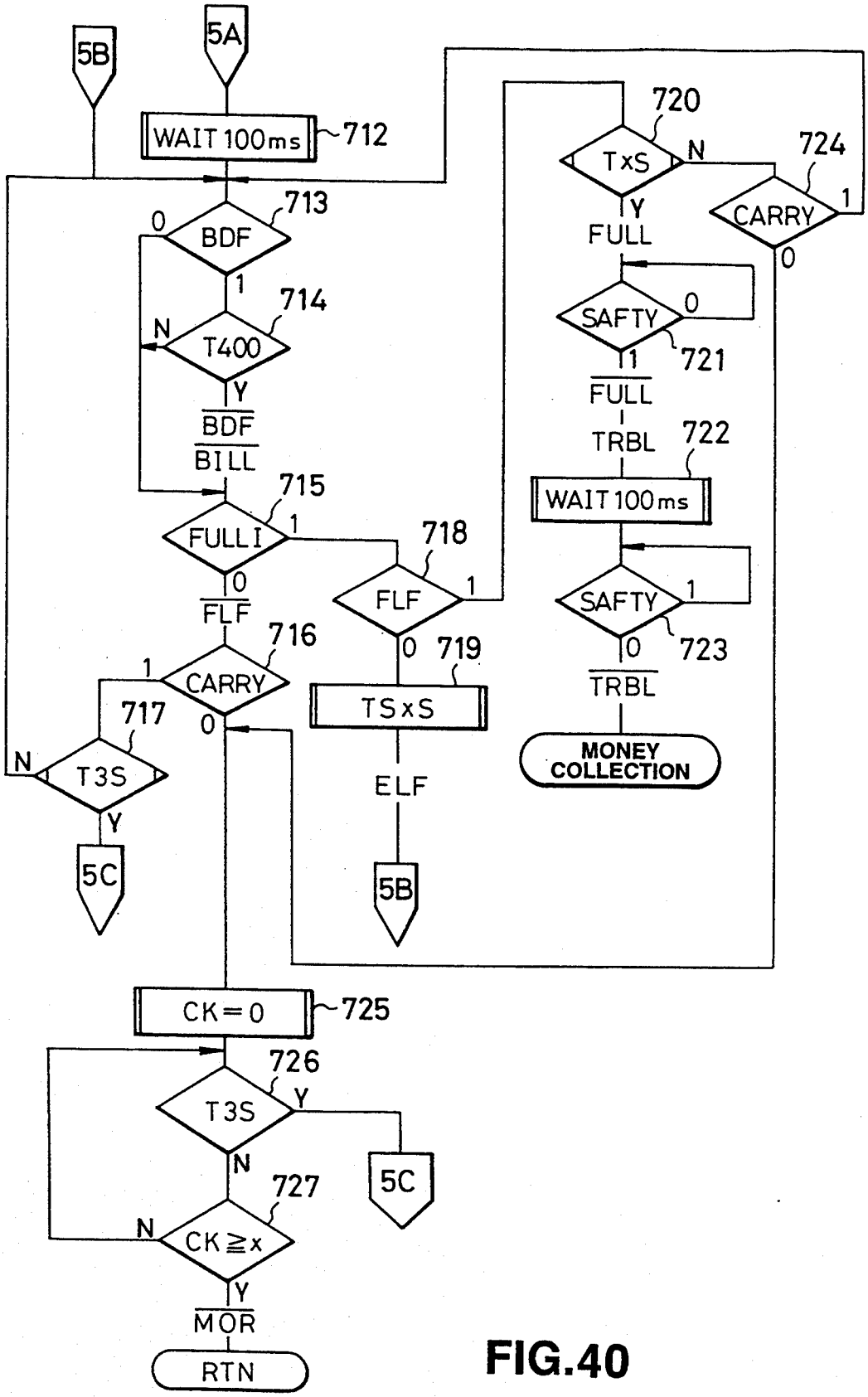
Figure 41:
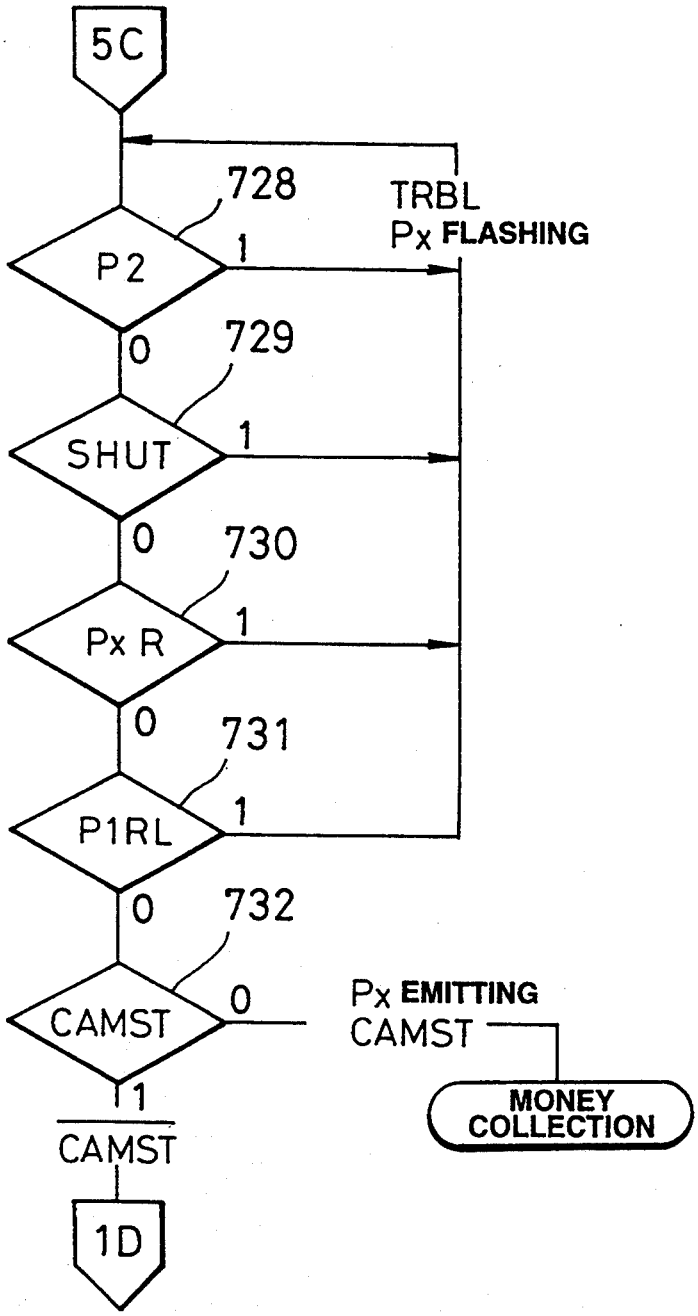

Stacking operation:

FIGS. 39 to 41 show the stacking operation.

In FIG. 39, the controller first starts the 3 sec. timer (step 702). And the controller sets the motor reverse drive signal MOR at "1" to reversely drive the motor 50. The controller next examines the genuine bill delay flag BDF (step 703). When the genuine bill delay flag BDF has a level of "1", the controller examines whether 400 msec. elapsed (step 704). When 400 msec. elapsed, the controller sets the genuine bill delay flag BDF at "0" and sets the genuine bill signal BILL at "0". Thereafter, the controller examines the carrier signal CARRY (step 705). When the carrier signal CARRY has a level of "0" the controller next examines whether or not the 3 sec. timer started in the step 702 expired (step 706). When determining in the step 706 that the timer did not expire yet, the controller returns to the step 703; while when determining that the timer expired already, the controller sets the optical sensors PxL, PxC and PxR in the emission flashing state and then examines the paper money passage detection signal P2, the shutter signal SHUT, the output of the optical sensor PxR and the inlet signal PIRL (steps 707, 708, 709 and 710). When the paper money passage detection signal P2, the shutter signal SHUT, the output of the optical sensor PxR and the inlet signal PIRL have all a level of "0", the controller next examines the carrier switch flag CAMST (step 711). When the carrier switch flag CAMST has a level of "0", the controller sets the carrier switch flag CAMST at "1", sets the optical sensors PxL, PxC and PxR in the light emission state, and shifts to the money collecting operation.

When determining in the step 711 that the carrier switch flag CAMST has a level of "1", the controller sets the carrier switch flag at "0", shifts to the flowchart of FIG. 18, and sets the abnormality signal TRBL at "1".

When determining in the steps 707, 708, 709 and 710 that any of the paper money passage detection signal P2, the shutter signal SHUT, the output of the optical sensor PxR and the inlet sensor signal PIRL has a level of "1", the controller sets the optical sensors PxL, PxC and PxR in the emission flashing state, sets the abnormality signal TRBL at "1", and returns to the step 707.

When determining in the step 703 that the genuine bill delay flag BDF has a level of "0" or determining in the step 704 that 400 msec did not elapse yet, the controller shifts to the step 705.

When determining in the step 705 that the carrier signal CARRY has a level of "0", the controller shifts to the flowchart of FIG. 40, waits for 100 msec. (step 712), and then examines the genuine bill delay flag BDF (step 713). When the genuine bill delay flag BDF has a level of "1", the controller examines whether or not 400 msec. elapsed (step 714). When 400 msec. elapsed, the controller sets the genuine bill delay flag BDF at "0" and sets the genuine bill signal BILL at "0". Next, the controller examines the fully-stacked-money detection signal FULLI (step 715). When determining in the step 713 that the genuine bill delay flag BDF has a level of "0" or determining in the step 714 that 400 msec did not elapse yet, the controller shifts to the step 715.

When determining in the step 715 that the fully-stacked-money detection signal FULLI has a level of "0" the controller sets the full flag FLF at "0" and examines the carrier signal CARRY (step 716). When the carrier signal CARRY has a level of "0", the controller clears the counted value CK of the motor pulse MOPLS to zero (step 725), and then examines whether or not the 3 sec. timer started in the step 702 expired (step 726). When the timer did not expire yet, the controller examines whether or not the counted value CK of the motor pulse MOPLS is larger than the predetermined value x, i.e., whether or not the relationship $CK \geqq x$ is satisfied (step 727). When the relationship $CK \geqq x$ is not satisfied, the controller returns to the step 726; while when the relationship $CK \geqq x$ is satisfied, the controller sets the motor reverse drive signal MOR at "0" and returns.

When determining in the step 715 that the fully-stacked-money current detection signal FULLI has a level of "1", the controller examines the full flag FLF (step 718). When the full flag FLF has a level of "0", the controller starts the x sec. timer (step 719) and returns to the step 713.

When determining in the step 718 that the full flag FLF has a level of "1", the controller then examines whether or not the x sec. timer started in step 719 expired (step 720). When the x sec. timer did not expire yet, the controller examines the carrier signal CARRY (step 724). When the carrier signal CARRY has a level of "1", the controller returns to the step 713; while when the carrier signal CARRY has a level of "0", the controller shifts to the step 725.

When determining in the step 720 that the x sec. timer started in the step 719 expired already, the controller sets the full signal FULL at "1", and examines the safety signal SAFTY (step 721). When the safety signal SAFTY has a level of "0", the controller returns to the step 721; while when the safety signal SAFTY has a level of "1", the controller sets the full signal FULL at "0", sets the abnormality signal TRBL at "1" waits for 100 msec. (step 722), and again examines the safety signal SAFTY (step 723). When the safety signal SAFTY has a level of "1", the controller returns to the step 23; while when the safety signal SAFTY has a level of "0", the controller sets the abnormality signal TRBL at "0" and shifts to the money collecting operation.

When determining in the step 716 that the carrier signal CARRY has a level of "1", the controller next examines whether or not the 3 sec. timer started in the step 702 expired (step 717). When the timer did not expire yet, the controller returns to the step 713.

When determining in the step 717 that the 3 sec. timer started in the step 702 expired already or determining in the step 726 that 3 sec. timer started in the step 702 expired already, the controller shifts to the flowchart of FIG. 41. In the flowchart of FIG. 41, the controller examines the paper money passage detection signal P2, the shutter signal SHUT, the output of the optical sensor PxR and the inlet sensor signal PIRL (steps 728, 729, 730 and 731). When the paper money passage detection signal P2, the shutter signal SHUT, the output of the optical sensor PxR and the inlet sensor signal PIRL have all a level of "0", the controller next examines the carrier switch flag CAMST (step 732). When the carrier switch flag CAMST has a level of "0", the controller sets the carrier switch flag CAMST at "1", sets the optical sensors PxL, PxC and PxR in the light emission state, and shifts to the money collecting operation.

When determining in the step 732 that the carrier switch flag CAMST has a level of "1" the controller sets the carrier switch flag CAMST at "0", shifts to the flowchart of FIG. 18, and sets the abnormality signal TRBL at "1".

What is claimed is:

1. A paper money processor comprising:

a paper money transporter section for transporting a paper money inserted through a paper money insert slot along a paper money transportation path into an interior of a processor body;

a data reader section disposed in the paper money transportation path for reading data for determination of whether or not the inserted paper money is genuine;

a paper money accommodation section having means for pushing the transported paper money determined to be genuine on the basis of the data read out by the data reader section into a paper money accommodation box for accumulative accommodation;

a driver section for transmitting driving forces to the paper money transporter section and the pushing means, the driver section including a single motor and power transmission means for transmitting a rotational force of the motor only to the paper money transporter section to cause only the paper money transporter section to drive the paper money into the interior of the processor body when the motor is forwardly driven and for transmitting a rotational force of the motor both to the paper money transporter section and the pushing means to cause the paper money transporter section to drive and return the paper money toward the paper money insert slot when the motor is reversely driven; and control means, when a repayment demand occurs, for causing the single motor to be reversely driven so long as the paper money inserted through the paper money insert slot is at a returnable position.

2. A paper money processor as set forth in claim 1, wherein the control means includes returnable position judgement means for judging whether or not the paper money inserted through the paper money insert slot is at the money returnable position and reverse-drive command generation means, when the repayment demand occurs, for issuing a reverse-drive command to the motor so long as the paper money is judged by the money returnable position judgement means to be at the money returnable position.

3. A paper money processor as set forth in claim 2, wherein the paper money transporter section includes an inlet sensor disposed in the vicinity of the paper money insert slot for detecting the paper money inserted through the paper money insert slot, a shutter switch disposed downstream side of the data reader section for detecting a pivotal movement of a pull-out prevention lever pivoted by engagement with the paper money inserted through the paper money insert slot to prevent the paper money from being pulled out through return of the pivotal movement to an original position, and a paper money passage detection switch disposed upstream side of an accumulative accommodation position of the paper money for detecting the passage of the paper money, and wherein the returnable position judgement means detects on the basis of outputs of the inlet sensor, the shutter switch and the paper money passage detection switch a state of the pull-out prevention lever before the lever is returned to the original position to judge the state as the paper money returnable position.

4. A paper money processor as set forth in claim 3, wherein the inlet sensor includes a pair of levers disposed in the vicinity of the paper money insert slot to be pivoted by the engagement with the paper money inserted through the paper money insert slot and optical switch means for optically detecting the fact that the pair of levers were pivoted at the same time.

5. A paper money processor as set forth in claim 3, wherein the paper money passage detection switch includes a paper money passage lever disposed in the vicinity of the accumulative accommodation position of the paper money and upstream thereof to be pivoted by the engagement with the paper money fed along the paper money transportation path and optical switch means for optically detecting a pivotal movement of the paper money passage lever.

6. A paper money processor as set forth in claim 1, wherein the control means, as the paper money is fed along the paper money transportation path, receives data issued from the data reader section according to a predetermined sampling pulse signal, judges as necessary whether or not the paper money is genuine on the basis of the received data and, when judging the paper money is not genuine, issues a reverse-drive command to the motor to perform a repayment operation.

7. A paper money processor as set forth in claim 6, wherein the sampling pulse signal is a motor pulse signal generated when the motor is forwardly driven.

8. A paper money processor as set forth in claim 7, wherein the data reader section includes first and second optical sensors disposed at both ends of the paper money transportation path for detecting light passed through the paper money fed along the paper money transportation path, a third optical sensor disposed in the center of the paper money transportation path for detecting light passed through the paper money fed along the paper money transportation path, and first and second magnetic sensors disposed at both ends of the paper money transportation path for detecting a magnetic characteristic of the paper money fed along the paper money transportation path, and wherein the control means receives output data read out by the first, second and third optical sensors and by the first and second magnetic sensors in synchronism with the motor pulse signal and performs a judgement-on-demand operation on the basis of the received data.

9. A paper money processor as set forth in claim 8, wherein the control means includes first memory means for storing at respective addresses the output data read out by the first, second and third optical sensors and by the first and second magnetic sensors in synchronism with the motor pulse signal and received in the control as ratio data with respect to predetermined reference data, second memory means for storing therein threshold values corresponding to the data stored in the first memory means at the respective addresses, and means for performing the judgement-on-demand operation by sequentially comparing the data stored in the first memory means with the data stored in the second memory means with respect to the respective addresses.

10. A paper money processor as set forth in claim 9, wherein the judgement-on-demand operation is carried out with respect to 4 directions corresponding to insertion directions of the paper money by judging that the inserted paper money is not genuine when the paper money is not judged as genuine one with respect to any of the four directions.

11. A paper money processor as set forth in claim 9, wherein the control means, when the data are stored at all the addresses of the first memory means, judges whether or not the paper money is genuine on the basis of a distribution of the data corresponding to the first, second and third optical sensors and stored in the first memory means, and, when judging that the paper money is genuine, generates a genuine bill signal.

* * * * *